US007516583B2

(12) United States Patent
Mitchell

(10) Patent No.: US 7,516,583 B2
(45) **Date of Patent: *Apr. 14, 2009**

(54) METHOD AND APPARATUS FOR ERECTING WALL PANELS

(75) Inventor: Everett Lee Mitchell, Evergreen, CO (US)

(73) Assignee: Elward Systems Corporation, Lakewood, CO (US)

( * ) Notice: Subject to any disclaimer, the term of this patent is extended or adjusted under 35 U.S.C. 154(b) by 647 days.

This patent is subject to a terminal disclaimer.

(21) Appl. No.: 10/437,549

(22) Filed: May 13, 2003

(65) Prior Publication Data

US 2003/0192270 A1 Oct. 16, 2003

Related U.S. Application Data

(60) Division of application No. 09/886,297, filed on Jun. 20, 2001, now Pat. No. 7,272,913, which is a continuation of application No. 09/334,124, filed on Jun. 15, 1999, now Pat. No. 6,330,772, which is a continuation of application No. 08/989,748, filed on Dec. 12, 1997, now Pat. No. 5,916,100.

(51) Int. Cl.
*E04B 2/88* (2006.01)
*E04B 2/90* (2006.01)

(52) U.S. Cl. ..... 52/235; 52/474; 52/302.3; 52/302.1; 52/506.01

(58) Field of Classification Search ..... 52/235, 52/474, 234, 302.1, 506.01, 543, 490, 506.04, 52/302.3, 480
See application file for complete search history.

(56) References Cited

U.S. PATENT DOCUMENTS

| | | | | |
|---|---|---|---|---|
| 754,888 | A | 3/1904 | Pease | |
| 2,124,748 | A | 7/1938 | Ransom | |
| 2,304,423 | A | 12/1942 | Schiller | 52/204.72 |
| 2,414,628 | A | 1/1947 | Battin | |
| 2,885,040 | A * | 5/1959 | Grossman | 52/207 |
| 3,053,353 | A | 9/1962 | Miller | 52/204.62 |
| 3,081,849 | A | 3/1963 | Hubbard | 52/204.6 |
| 3,190,408 | A | 6/1965 | Petterson | |
| 3,210,808 | A | 10/1965 | Creager | |
| 3,212,225 | A | 10/1965 | Neal | 52/204.7 |
| 3,333,429 | A | 8/1967 | Dougherty | |

(Continued)

FOREIGN PATENT DOCUMENTS

FR 1285427 1/1961

(Continued)

OTHER PUBLICATIONS

Robertson, Curtain Wall Systems Formawall 1000/2000 Technical Data Details, 1998 H. H. Roberston Compnay, pp. 1-34.

(Continued)

*Primary Examiner*—A. Phi Dieu Tran
(74) *Attorney, Agent, or Firm*—Sheridan Ross P.C.

(57) ABSTRACT

The wall panel system of the present invention includes a flexible sheet interlock to flexibly seal a joint defined by adjacent perimeter framing members and a capillary break to inhibit the entry of water into drainage or weep holes in gutters in the perimeter framing members.

32 Claims, 16 Drawing Sheets

U.S. PATENT DOCUMENTS

| | | | | | |
|---|---|---|---|---|---|
| 3,340,663 | A | | 9/1967 | Collard | 52/204.6 |
| 3,357,145 | A | | 12/1967 | Grossman | |
| 3,429,090 | A | | 2/1969 | Metelnick | 52/481 |
| 3,436,885 | A | | 4/1969 | Rothermel | 52/207 |
| 3,460,282 | A | | 8/1969 | Swirsky | |
| 3,566,561 | A | | 3/1971 | Tozer | 52/204.62 |
| 3,608,264 | A | | 9/1971 | Jones et al. | |
| 3,736,717 | A | | 6/1973 | Farley | 52/476 |
| 3,805,470 | A | | 4/1974 | Brown | 52/397 |
| 3,848,388 | A | | 11/1974 | Bretche | |
| 3,858,375 | A | * | 1/1975 | Silvernail | 52/235 |
| 3,973,368 | A | | 8/1976 | Moeller | 52/476 |
| 4,053,008 | A | | 10/1977 | Baslow | 160/327 |
| 4,057,947 | A | | 11/1977 | Oide | 52/496 |
| 4,070,806 | A | | 1/1978 | Hubbard | 52/95 |
| 4,081,941 | A | | 4/1978 | Van Ausdell | |
| 4,114,330 | A | | 9/1978 | Sukolics | 52/200 |
| 4,123,883 | A | | 11/1978 | Barber, Jr. et al. | 52/200 |
| 4,344,267 | A | | 8/1982 | Sukolics | 52/762 |
| 4,364,209 | A | | 12/1982 | Gebhard | |
| 4,423,582 | A | | 1/1984 | Yates | |
| 4,452,029 | A | | 6/1984 | Sukolics | 52/747 |
| 4,470,647 | A | | 9/1984 | Bishoff et al. | |
| 4,483,122 | A | | 11/1984 | Crandell | |
| 4,525,966 | A | | 7/1985 | Litchfield et al. | 52/397 |
| 4,563,849 | A | | 1/1986 | Mangal | 52/235 |
| 4,644,717 | A | | 2/1987 | Biebuyck | |
| 4,662,145 | A | | 5/1987 | Tanikawa et al. | 52/745 |
| 4,685,263 | A | | 8/1987 | Ting | 52/235 |
| 4,833,858 | A | | 5/1989 | Hutchison | |
| 4,840,004 | A | | 6/1989 | Ting | 52/235 |
| 4,866,896 | A | | 9/1989 | Shreiner et al. | 52/235 |
| 4,873,806 | A | | 10/1989 | Jeschke | |
| 4,924,647 | A | | 5/1990 | Drucker | 52/235 |
| 4,961,298 | A | | 10/1990 | Nogradi | |
| 4,986,046 | A | | 1/1991 | Mazzarantani | |
| 5,036,640 | A | * | 8/1991 | Niwata et al. | 52/235 |
| 5,039,177 | A | | 8/1991 | Newell et al. | |
| 5,046,293 | A | * | 9/1991 | Kajiura | 52/209 |
| 5,065,557 | A | * | 11/1991 | Laplante et al. | 52/235 |
| 5,095,676 | A | | 3/1992 | Mühle | 52/476 |
| 5,139,846 | A | | 8/1992 | Herwegh et al. | |
| 5,154,026 | A | | 10/1992 | Strobl et al. | |
| 5,184,440 | A | | 2/1993 | Felix et al. | 52/235 |
| 5,226,274 | A | | 7/1993 | Sommerstein | |
| 5,263,292 | A | | 11/1993 | Holland et al. | |
| 5,323,577 | A | * | 6/1994 | Whitmyer | 52/235 |
| 5,444,945 | A | | 8/1995 | Goodwin | 52/65 |
| 5,452,552 | A | * | 9/1995 | Ting | 52/235 |
| 5,464,359 | A | | 11/1995 | Whitty | |
| 5,579,624 | A | | 12/1996 | Aeberhard | |
| 5,598,671 | A | * | 2/1997 | Ting | 52/235 |
| 5,709,056 | A | | 1/1998 | Matsuyama et al. | |
| 5,735,089 | A | | 4/1998 | Smith et al. | 52/202 |
| 5,797,229 | A | | 8/1998 | Alvarez et al. | 52/204.62 |
| 5,802,789 | A | | 9/1998 | Goodman et al. | |
| 5,809,729 | A | | 9/1998 | Mitchell | 52/474 |
| 5,813,179 | A | | 9/1998 | Koenig et al. | |
| 5,845,440 | A | | 12/1998 | Matsuyama et al. | |
| 5,875,592 | A | | 3/1999 | Allman et al. | 52/90.2 |
| 5,907,927 | A | | 6/1999 | Lieb et al. | |
| 5,916,100 | A | * | 6/1999 | Mitchell et al. | 52/235 |
| 6,082,064 | A | * | 7/2000 | Mitchell et al. | 52/235 |
| 6,105,333 | A | | 8/2000 | Meesemaeeker et al. | 52/716.8 |
| 6,138,419 | A | | 10/2000 | Sekiguchi et al. | 52/235 |
| 6,170,214 | B1 | | 1/2001 | Treister et al. | |
| 6,298,616 | B1 | | 10/2001 | Mitchell et al. | 52/235 |
| 6,330,772 | B1 | | 12/2001 | Mitchell et al. | 52/235 |
| 6,425,218 | B1 | | 7/2002 | Doyon et al. | |
| 6,517,056 | B2 | | 2/2003 | Shepherd | |
| 6,557,955 | B2 | | 5/2003 | Saravis | |
| 6,745,527 | B1 | | 6/2004 | Sherman et al. | |
| 6,748,709 | B1 | | 6/2004 | Sherman et al. | |
| 7,036,799 | B2 | | 5/2006 | Shepherd | |
| 7,048,346 | B2 | | 5/2006 | Saravis | |
| 2002/0026758 | A1 | | 3/2002 | Mitchell | 52/235 |
| 2002/0134034 | A1 | | 9/2002 | Mitchell | 52/235 |
| 2007/0094965 | A1 | | 5/2007 | Mitchell | |

FOREIGN PATENT DOCUMENTS

| | | | | |
|---|---|---|---|---|
| JP | 5-156733 | | 6/1993 | |
| JP | 5-280171 | | 10/1993 | |
| JP | 26141 | * | 2/1994 | 52/235 |
| JP | 6-136863 | | 5/1994 | |
| JP | 6-146447 | | 5/1994 | |
| JP | 136863 | * | 5/1994 | 52/235 |
| JP | 146447 | * | 5/1994 | 52/235 |
| JP | 6-221059 | | 9/1994 | |
| JP | 6-264542 | | 9/1994 | |
| JP | 264542 | * | 9/1994 | 52/235 |
| JP | 6-26141 | | 2/2004 | |
| WO | PCT/US97/03491 | | 9/1997 | |
| WO | WO 97/33052 | | 12/1997 | |

OTHER PUBLICATIONS

Formawall, Panel and Window Systems, Detailed Drawings, H. H. Robertson, pp. 1-101.

Anderson, et al. "Rainscreen Cladding a guide to design principles and practice," 1988, pp. 1-98.

BD&C Emerging Technology, "Wall Systems Strive to Foil Moisture Intrusion," May 1991, 4 pages.

Canadian Examination Report issued in corresponding Canadian Application No. 2,255,534 on Apr. 10, 2006.

A UL Recognized Component "How To" manual addressing the fabrication of 3 mm, 4 mm, and 6 mm alucobond material, undated, pp. 1-52.

"Dow Corning 123 Silicone Seal", 1996 (1998), 4 pages, Dow Corning Corporation.

"Alucobond Material Featured at Port Authority", available at http://www.alucobondusa.com/news_headlines_detail, asp?id=1, Sep. 26, 1997.

"TingWall Gude Specification", available at http://www.crystalwindows.com/tw_spec.pdf, 1997 edition, p. 1-23.

Canadian Examination Report issued in corresponding Canadian Application No. 2,255,535 mailed Apr. 21, 2006.

Alucobond "How To" Product Manual, 1987, 75 pages plus Front Cover, Table Of Contents and Back Cover, Alucobond Technologies, Incorporated.

Canadian Examination Report issued in corresponding Canadian Application No. 2,255,534 mailed Mar. 13, 2007.

Canadian Examination Report issued in corresponding Canadian Application No. 2,255,535 mailed Mar. 13, 2007.

Official Action for U.S. Appl. No. 11/610,584, mailed Jul. 17, 2008.

Official Action (Restriction Requirement) for U.S. Appl. No. 11/610,584, mailed Mar. 18, 2008, pp. 1-7.

Notice of Allowance for U.S. Patent Appl. No. 09/886,297, mailed Apr. 10, 2007.

Notice of Allowance for U.S. Appl. No. 09/886,297, mailed Dec. 1, 2006.

Notice of Allowance for U.S. Appl. No. 09/886,297, mailed Jul. 24, 2006.

Office Action for U.S. Appl. No. 09/886,297, mailed Dec. 6, 2005.

Office Action for U.S. Appl. No. 09/886,297, mailed Jun. 22, 2005.

Office Action for U.S. Appl. No. 09/886,297, mailed Jun. 30, 2004.

Office Action for U.S. Appl. No. 09/886,297, mailed Jan. 13, 2004.

Office Action for U.S. Appl. No. 09/886,297, mailed Jul. 16, 2003.

Office Action for U.S. Appl. No. 09/886,297, mailed Feb. 26, 2002.

Notice of Allowance for U.S. Appl. No. 09/334,124, mailed Jun. 1, 2001.

Office Action for U.S. Appl. No. 09/334,124, mailed Dec. 14, 2000.

Office Action for U.S. Appl. No. 09/334,124, mailed Sep. 22, 2000.

Notice of Allowance for U.S. Appl. No. 08/869,245, mailed Feb. 22, 1999.

Office Action for U.S. Appl. No. 08/869,245, mailed Sep. 29, 1998.
Notice of Allowance for U.S. Appl. No. 09/607,622, mailed Mar. 30, 2001.
Office Action for U.S. Appl. No. 09/607,622, mailed Nov. 21, 2000.
Notice of Allowance for U.S. Appl. No. 08/989,749, mailed Jan. 3, 2000.
Official Action for U.S. Appl. No. 08/989,749, mailed Jul. 20, 1999.
"Dow Corning® 123 Weatherseal Repair", Dow Corning Corporation, 1995, pp. 1-4.
"Dow Corning® 123 SPECDATA", Dow Corning Corporation, Feb. 1995, pp. 1-4.
"Dow Corning® 123 Weatherseal Repair", Dow Corning Corporation, 1995, 1999, pp. 1-4.
Notice of Allowance issued in corresponding Canadian Application No. 2,255,535 mailed Jan. 22, 2008.
Canadian Examination Report issued in corresponding Canadian Application No. 2,255,534 mailed Jan. 7, 2008.
Official Action for U.S. Appl. No. 10/138,444, mailed Feb. 13, 2008, pp. 1-16.
Official Action for U.S. Appl. No. 10/138,444, mailed Jul. 17, 2007, pp. 1-21.
Official Action for U.S. Appl. No. 10/138,444, mailed Oct. 18, 2006, pp. 1-19.
Official Action for U.S. Appl. No. 10/138,444, mailed May 8, 2006, pp. 1-6.
Official Action for U.S. Appl. No. 10/138,444, mailed Nov. 30, 2005, pp. 1-6.
Official Action for U.S. Appl. No. 10/138,444, mailed Apr. 7, 2005, pp. 1-9.
Official Action for U.S. Appl. No. 10/138,444, mailed Aug. 25, 2004, pp. 1-9.
Official Action for U.S. Appl. No. 10/138,444, mailed Jan. 6, 2004, pp. 1-10.
Official Action for U.S. Appl. No. 10/138,444, mailed Jul. 1, 2003, pp. 1-10.
Official Action for U.S. Appl. No. 10/138,444, mailed Jan. 15, 2003, pp. 1-11.
Official Action for U.S. Appl. No. 10/138,444, mailed Oct. 3, 2002, pp. 1-4.
Official Action for U.S. Appl. No. 10/138,444, mailed Jan. 23, 2009.

* cited by examiner 50b
58b
50a
62b
70b
58a
70a
54b
54a
66b
2
58d
2
70d
62a
54d
66a
58c
70c
62d
54c
66d
50d
62c
66c
50c
58b 66b
83
58d
82
74

66d 54a
83
74
58c
66a
78a
78b
78c
54c

FIG. 6A
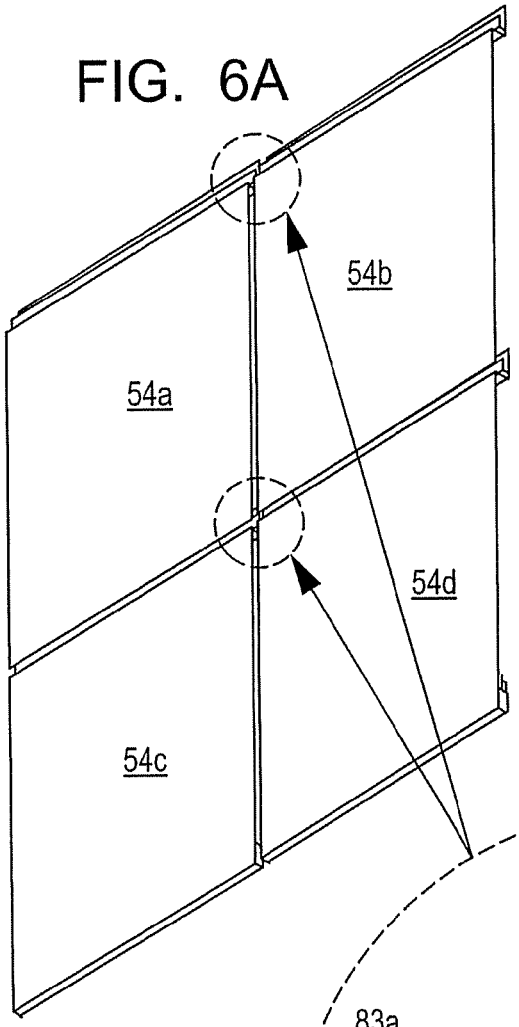
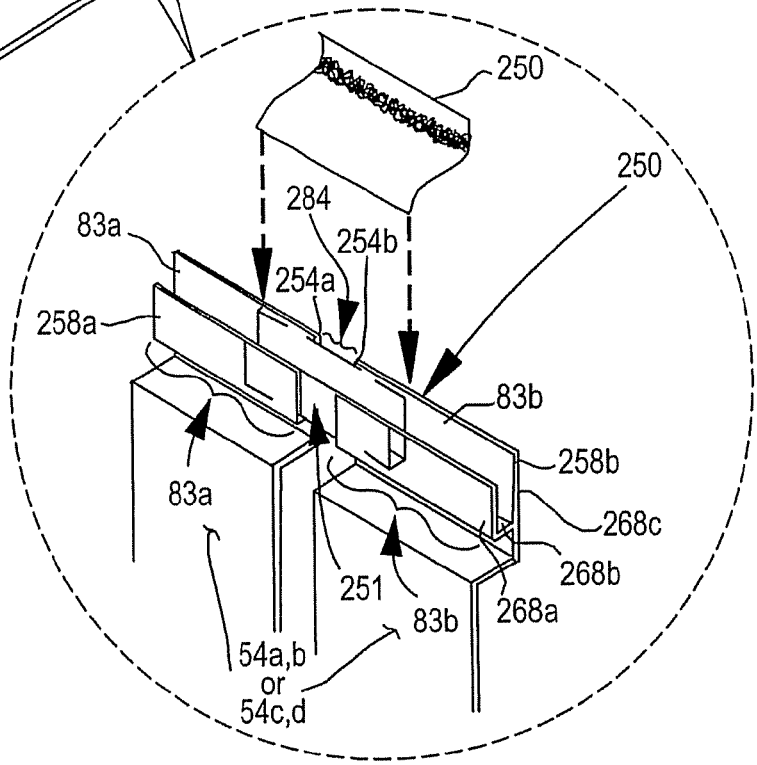
FIG. 6B

METHOD AND APPARATUS FOR ERECTING WALL PANELS

CROSS REFERENCE TO RELATED APPLICATION

The present application is a divisional application of U.S. patent application Ser. No. 09/886,297 filed Jun. 20, 2001 now U.S. Pat. No. 7,272,913, which is a continuation application of U.S. patent application Ser. No. 09/334,124 filed Jun. 15, 1999, now U.S. Pat. No. 6,330,772, which is a continuation application of U.S. patent application Ser. No. 08/989,748, filed Dec. 12, 1997, now U.S. Pat. No. 5,916,100, each of which is incorporated herein by this reference.

FIELD OF THE INVENTION

The present invention is directed generally to apparatus and methods for erecting wall panels and specifically to perimeter framing members for attaching wall panels to structural members.

BACKGROUND OF THE INVENTION

The exterior walls of many commercial and industrial buildings are formed by mounting a number of wall panels and attached perimeter extrusions on a grid framework of structural members attached to the building. The resulting grid of wall panels are aesthetically attractive and protect the building structure from fluids in the terrestrial environment.

In designing a wall panel mounting system, there are a number of objectives. First, the joints between the wall panels should be substantially sealed from terrestrial fluids. Penetration of terrestrial fluids behind the wall panels can cause warpage and/or dislocation of the wall panels, which can culminate in wall panel failure. Second, any sealing material used in the joints between the wall panels should be non-skinning and non-hardening. The sealing material is located in a confined space in the joint. To maintain the integrity of the seal between the wall panels when the panels expand and contract in response to thermal fluctuations and other building movements (e.g., seismically induced movements), the sealing material must be able to move with the wall panels without failure of the seal. If the sealing material hardens or "sets up", the sealing material can break or shear, thereby destroying the weather seal. Third, the longevity of the sealing material should be at least as long as the useful life of the wall panels. Fourth, the sealing material should be capable of being pre-installed before erection of a wall panel beside a previously installed wall panel to provide for ease and simplicity of wall panel installation and low installation costs. Wall panel systems presently must be installed in a "stair step" fashion (i.e., a staggered or stepped method) because the sealing material must be installed only after both of the adjacent wall panels are mounted on the support members. Fifth, a drainage system or gutter should be employed to drain any fluids that are able to penetrate the seal in the joints. The gutter, which commonly is a "U"-shaped member in communication with a series of weep holes, must not overflow and thereby provide an uncontrolled entry for terrestrial fluids into the interior of the wall. During storms, winds can exert a positive pressure on the wall, thereby forcing terrestrial fluids to adhere to the surface of the wall (i.e., known as a capillary attraction). In other words, as the fluids follow the wall profile, the fluids can be drawn through the weep holes into gutter. The amount of terrestrial fluids drawn through the weep holes is directly proportional to the intensity of the storm pressure exerted on the wall exterior. If a sufficient amount of fluids enter the weep holes, the gutter can overflow, leaking fluids into the wall interior. Such leakage can cause severe damage or even panel failure.

SUMMARY OF THE INVENTION

These and other design considerations are addressed by the wall panel attachment system of the present invention. In a first aspect of the present invention, the wall panel attachment system includes an upper perimeter framing member attached to an upper wall panel and a lower perimeter framing member attached to a lower wall panel. The upper and lower perimeter framing members engage one another at perimeter edges of the upper and lower, typically vertically aligned, wall panels to define a recess relative to the upper and lower wall panels. At least one of the upper and lower perimeter framing members includes a plurality of drainage (or weep) holes for the drainage of terrestrial fluids located inside of the upper and lower perimeter framing members. At least one of the upper and lower perimeter framing members further includes a capillary break or blocking means (e.g., an elongated ridge running the length of the perimeter framing members) that (a) projects into the recess, (b) is positioned between the exterior of the upper and lower wall panels on the one hand and the plurality of drainage holes on the other, (c) is positioned on the same side of the recess as the plurality of drainage holes, and (d) is spaced from the plurality of drainage holes. The portion of the recess located interiorly of the capillary break is referred to as the circulating chamber. The capillary break inhibits terrestrial fluids, such as rainwater, from entering the plurality of drainage holes and substantially seals the joint between the upper and lower perimeter framing members from penetration by fluids.

While not wishing to be bound by any theory, the capillary break induces vortexing of any airstream containing droplets, thereby removing the droplets from the airstream upstream of the weep holes. Vortexing is induced by a decrease in the cross-sectional area of airflow (causing an increase in airstream velocity) as the airstream flows towards and past the capillary break followed by a sudden increase in the cross-sectional area of flow downstream of the capillary break (causing a decrease in airstream velocity). Behind and adjacent to the capillary break, the sudden decrease in airstream velocity causes entrained droplets to deposit on the surface of the recess. To induce vortexing, the capillary break can have a concave or curved surface on its rear surface (adjacent to the circulating chamber). The rear surface of the capillary break is adjacent to the weep holes.

To inhibit entry of the droplets into the weep holes adjacent to the capillary break, the weep holes must be located at a sufficient distance from the capillary break and a sufficient distance above the free end of the capillary break to remove the weep holes from the vortex. Preferably, the capillary break and weep holes are both positioned on the same side of a horizontal line intersecting the free end of the capillary break. Typically, the distance between the rear surface of the capillary break and the adjacent drainage holes (which are typically aligned relative to a common axis) is at least about 0.25 inches. Commonly, the distance of the weep holes above the free end of the capillary break is at least about 125% of the distance from the free end of the capillary break to the opposing surface of the recess.

The drainage holes and capillary break can be located on the same perimeter framing member or on different perimeter framing members.

To form a seal between the perimeter framing members of adjacent, horizontally aligned wall panels, a second aspect of the present invention employs a flexible sheet interlock, that is substantially impervious to the passage of terrestrial fluids, to overlap both of the perimeter framing members to inhibit the passage of terrestrial fluids in the space between the perimeter framing members.

The flexible sheet interlock is preferably composed of a sealing non-skinning and non-hardening material that has a useful life at least equal to that of the wall panels. In this manner, the integrity of the seal between the wall panels is maintained over the useful life of the panels. The most preferred sealing material is silicone or urethane. The flexible sheet interlock, being non-skinning and non-hardening, can move freely, in response to thermally induced movement of the wall panels, without failure of the seal.

The flexible sheet interlock can be pre-installed before erection of an adjacent wall panel to provide for ease and simplicity of wall panel installation and low installation costs. The flexible sheet interlock can be installed on the wall panel and folded back on itself during installation of the adjacent wall panel. After the adjacent wall panel is installed, the interlock can simply be unfolded to cover the joint between the adjoining wall panels.

BRIEF DESCRIPTION OF THE DRAWINGS

FIG. 6A depicts a number of adjoining wall panels sealed by a fourth embodiment of a wall panel mounting system according to the second aspect of the present invention briefly described in the Summary of the Invention section hereinabove;

FIG. 6B is an exploded view of interconnected lower perimeter framing members, e.g., 66*a* and 66*b*, of adjoining wall panels 54*c* and 54*d* of FIG. 6A viewed from the front of the wall panels, with the upper perimeter framing member removed to reveal the flexible sheet interlock 250;

DETAILED DESCRIPTION

Figures 1, 1A, 1B, 1C, 1D:
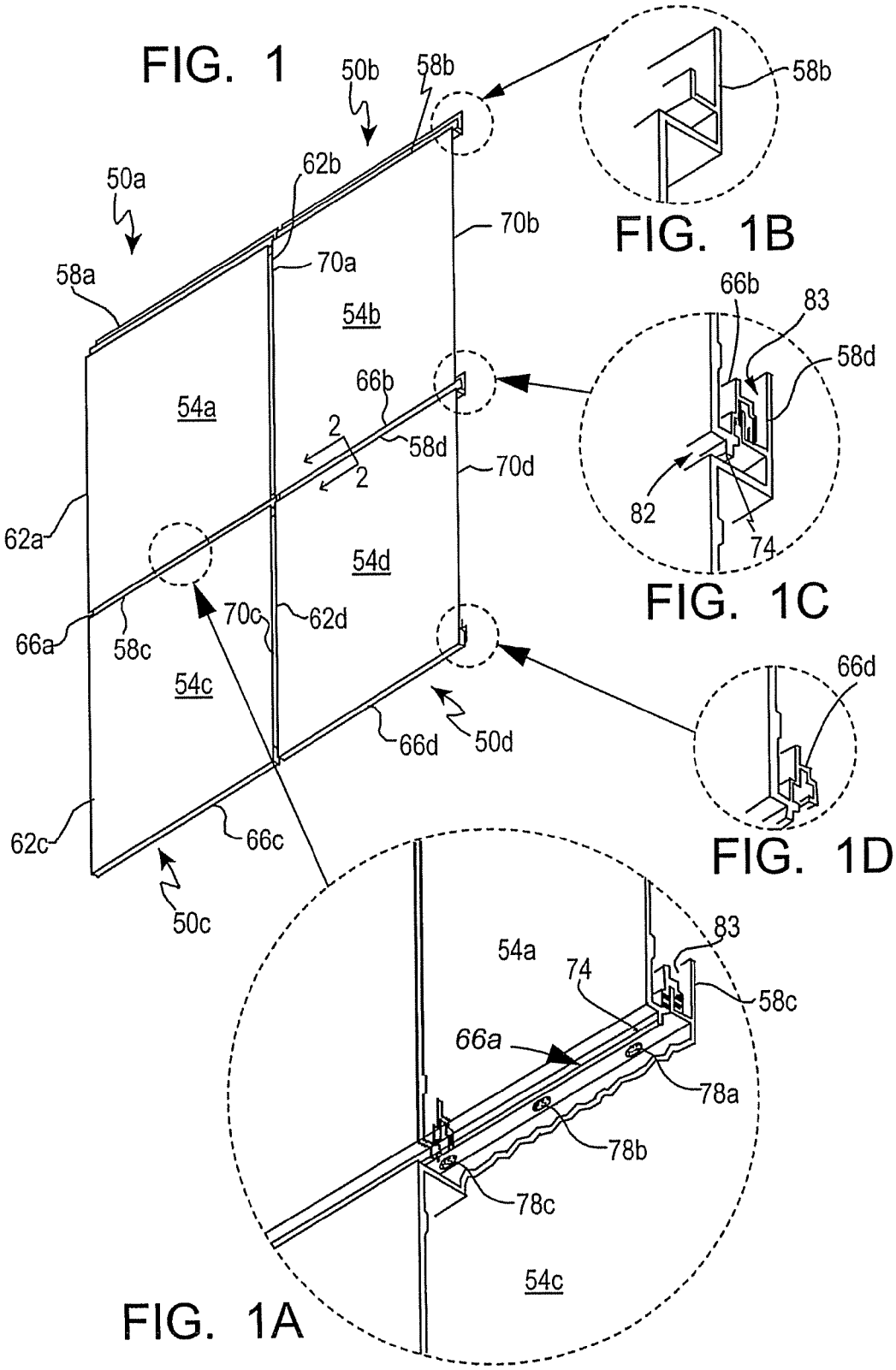
FIG. 1 depicts a number of adjoining wall panels attached by a first embodiment of the wall panel mounting system according to a first aspect of the present invention.
FIG. 1A is an exploded view of interconnected upper and lower perimeter framing members attached to panels 54*a* and 54*c* of the first embodiment viewed from in front of the wall panels, with a portion of the lower perimeter framing member 58*c* being cutaway to reveal the drainage holes 78 (in the lower perimeter framing member 58*c*, as is also illustrated in FIG. 2), and the capillary break 74 (in the upper perimeter framing member 66*a*, as is also illustrated in FIG. 2)
FIG. 1B is an exploded view of the lower perimeter framing member 58*b* of the first embodiment.
FIG. 1C is an exploded view of interconnected upper and lower perimeter framing members 66*b* and 58*d* of the first embodiment.
FIG. 1D is an exploded view of the upper perimeter framing member 58*d* of the first embodiment.

The first aspect of the present invention is directed to retarding the passage of terrestrial fluids through the joint between adjoining upper and lower wall panels. FIG. 1 depicts four adjacent wall panel mounting assemblies 50*a-d* and the attached vertically oriented wall panels 54*a-d* according to the first aspect of the present invention. Each wall panel mounting assembly 50*a-d* includes a number of perimeter framing members 58*a-d*, 62*a-d*, 66*a-d* and 70*a-d* engaging each edge of the wall panels 54*a-d*. Lower perimeter framing members 58 engage upper perimeter framing members 66, and perimeter framing members 62 engage perimeter framing members 70. As can be seen from FIGS. 1A and 1D, the upper perimeter framing members 66 (e.g., 66*a* and 66*b*) are configured to interlock in a nested relationship with corresponding lower perimeter framing members 58 (e.g., 58*c* and 58*d*). Referring to FIG. 1A, at least one of the upper and lower perimeter framing members has a capillary break 74 (FIGS. 1C and 2 as well), and a plurality of drainage holes 78*a-c* in communication with a gutter 83 (FIG. 2 as well), defined by the lower perimeter framing member in the present embodiment.

The wall panels 54 can be composed of a variety of materials, including wood, plastics, metal, ceramics, masonry, and composites thereof. A preferred composite wall panel 54 is metal- or plastic-faced with a wood, metal, or plastic core. A more preferred wall panel 54 is a composite of metal and plastics sold under the trademark "ALUCOBOND".

Figure 2:
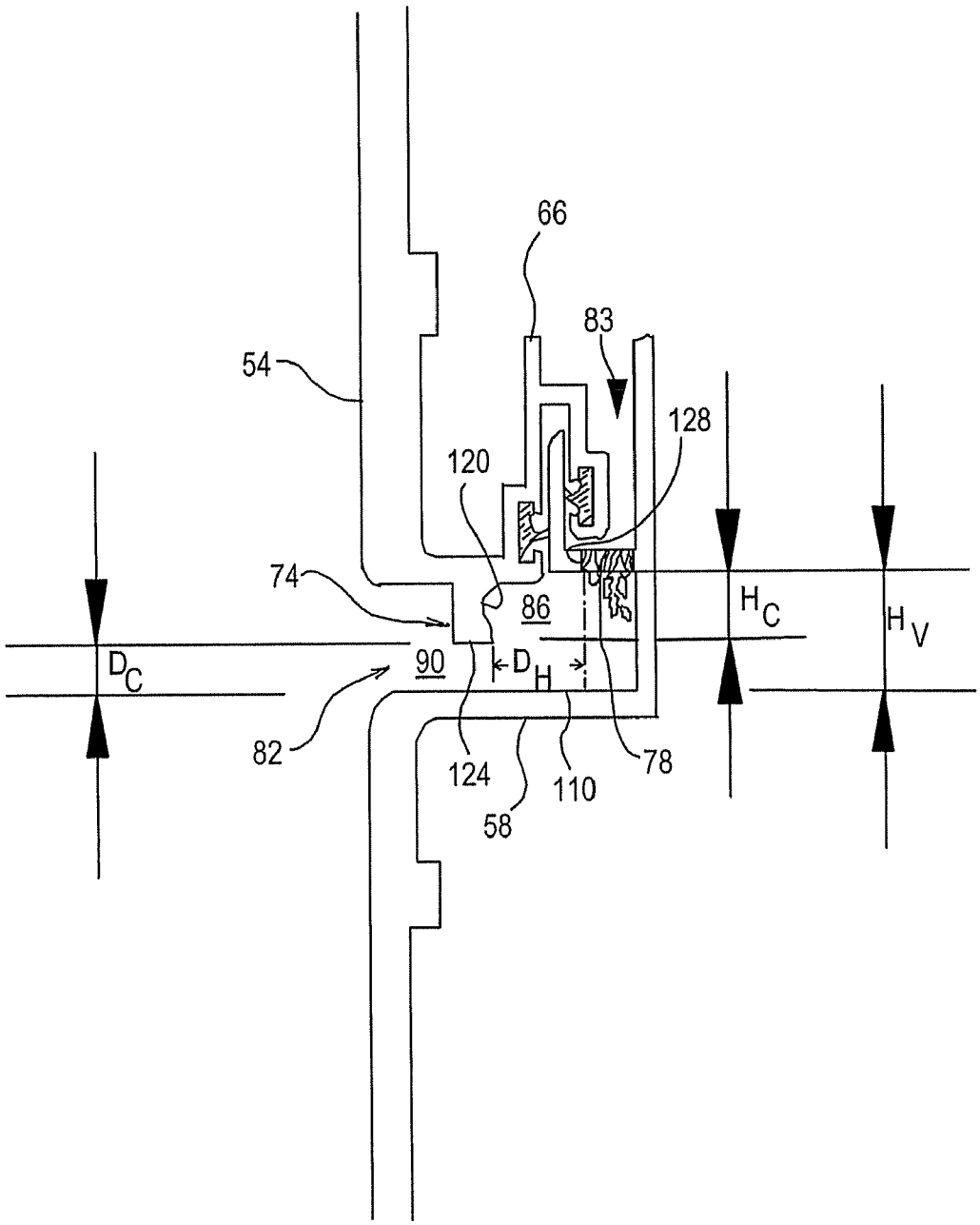
FIG. 2 is a cross-sectional view of the wall panel mounting system of the first embodiment taken along lines 2-2 of FIG. 1.
Figure 3:
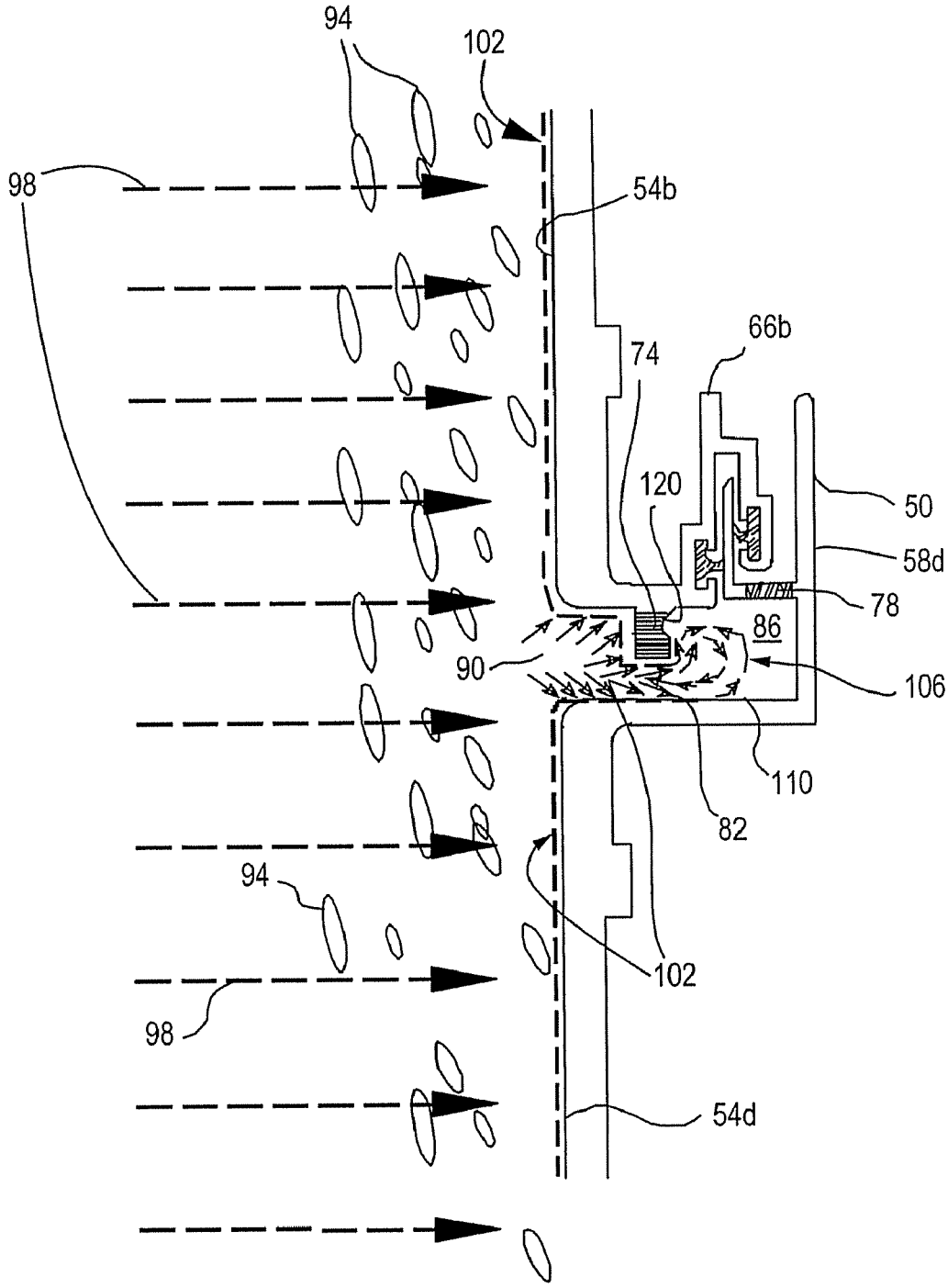
FIG. 3 is a sectional view of the wall panel mounting system of the first embodiment taken along lines 2-2 of FIG. 1 depicting the impact of the capillary break on airflow during a storm.

Referring to FIGS. 1C, 2 and 3, the upper and lower perimeter framing members 66 and 58 define a recess 82. The capillary break 74 extends downwardly from the upper perimeter framing member 66 to divide the recess 82 into a circulating chamber 86 and an inlet 90. The capillary break 74 is located nearer the wall panel 54 than the drainage holes 78 to block or impede the flow of droplets 94 (FIG. 3) entrained in the airstream 98 into the drainage holes 78.

FIG. 3 depicts the operation of the capillary break 74 and circulating chamber 86 during a storm. The airstream or wind 98 forces droplets of water 94 against the wall panels 54 (e.g., 54*b* and 54*d*). A film 102 of water forms on, e.g., the exterior surfaces of the wall. The wind pressure forces entrained droplets of water 94 and the film 102 into the inlet 90 between the wall panels 54*b* and 54*d*. The capillary break 74, which runs continuously along the length of each upper perimeter framing member 66 (e.g., 66*b* in FIG. 3), decreases the cross-sectional area of air flow and therefore increases the velocity of the droplets 94. As the entrained droplets 94 enter the circulating chamber 86, the cross-sectional area of flow increases and therefore the velocity of the droplets 94 decreases forming a vortex 106. As a result, the droplets 94 have insufficient velocity to remain entrained in the air and the droplets collect in the film 102 on the lower surface 110 of the recess 82.

The degree of vortexing of the airstream depends, of course, on the increase in the cross-sectional area of flow as the airstream flows past the capillary break 74 and into the circulating chamber 86. If one were to define the space between the free end 124 (FIG. 2) of the capillary break and the opposing wall (i.e., lower surface 110) of the recess 82 as having a first vertical cross-sectional area, and the space between the vertically spaced apart opposing walls of the circulating chamber 86 (i.e., the distance "$H_V$", FIG. 2) as having a second vertical cross-sectional area, the second vertical cross sectional area is preferably at least about 125% of the first vertical cross sectional area and more preferably at least about 150% of the first vertical cross sectional area.

The rear surface 120 (FIGS. 2 and 3) of the capillary break 74 has a concave or curved shape to facilitate the formation of the vortex 106.

The relative dimensions of the capillary break 74 are important to its performance. Preferably, the height "$H_C$" (FIG. 2) of the capillary break 74 is at least about 100%, and more preferably ranges from about 125% to about 200%, of the distance "'D'" (FIG. 2) between the free end 124 of the capillary break 74 and the opposing surface 110 of the recess 82.

The locations of the drainage holes 78 relative to the capillary break 74 is another important factor to performance. The drainage holes 78 are preferably located on the same side of the capillary break 74 as the circulating chamber 86 of the recess 82 (i.e., drainage holes 78 are in the upper portion of the circulating chamber 86 as shown in FIG. 2) such that the wind does not have a straight line path from the inlet 90 to a drainage hole 78. For a substantially horizontally oriented drainage hole 78, the distance "$D_H$" (FIG. 2) from the rear surface 120 of the capillary break 74 to the edge 128 (FIG. 2) of the drainage hole 78 must be sufficient to place the drainage hole outside of the vortex and more preferably is at least about 0.25 inches.

Figure 4:
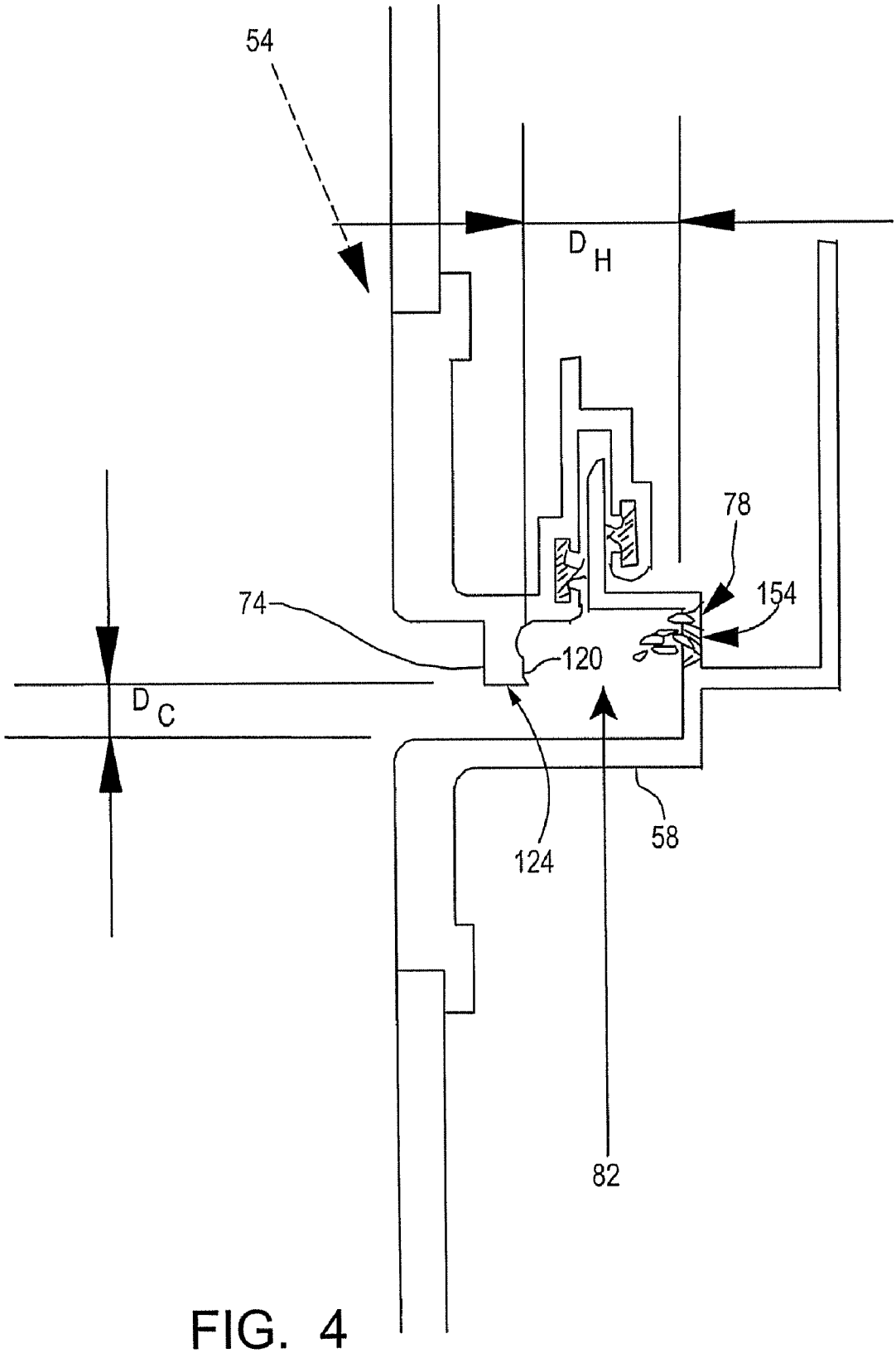
FIG. 4 is a second embodiment of a wall panel mounting system according to the first aspect of the present invention.

FIG. 4 depicts a second embodiment of a wall panel mounting assembly according to the first aspect of the present invention (this first aspect briefly described in the Summary of the Invention section hereinabove). In this second embodiment, drainage holes 78 are located on a substantially vertical surface 154 of an embodiment of the lower perimeter framing member 58. Because a vertically oriented drainage hole is more susceptible to the entry of fluids than the horizontally oriented drainage hole of FIG. 2, the preferred minimum distance "$D_H$" from the rear surface 120 of the capillary break 74 for this second embodiment is greater than the preferred minimum distance "$D_H$" from the rear surface for the first embodiment (e.g., FIG. 2). More preferably, the drainage hole 78 is located at least about 0.75 inches from the rear surface 120 of the capillary break 74. The center of the drainage hole 78 is located above the free end 124 (FIG. 4) of the capillary break 74 and more preferably the entire drainage hole 78 is located above the free end 124 of the capillary break 74.

Figure 5:
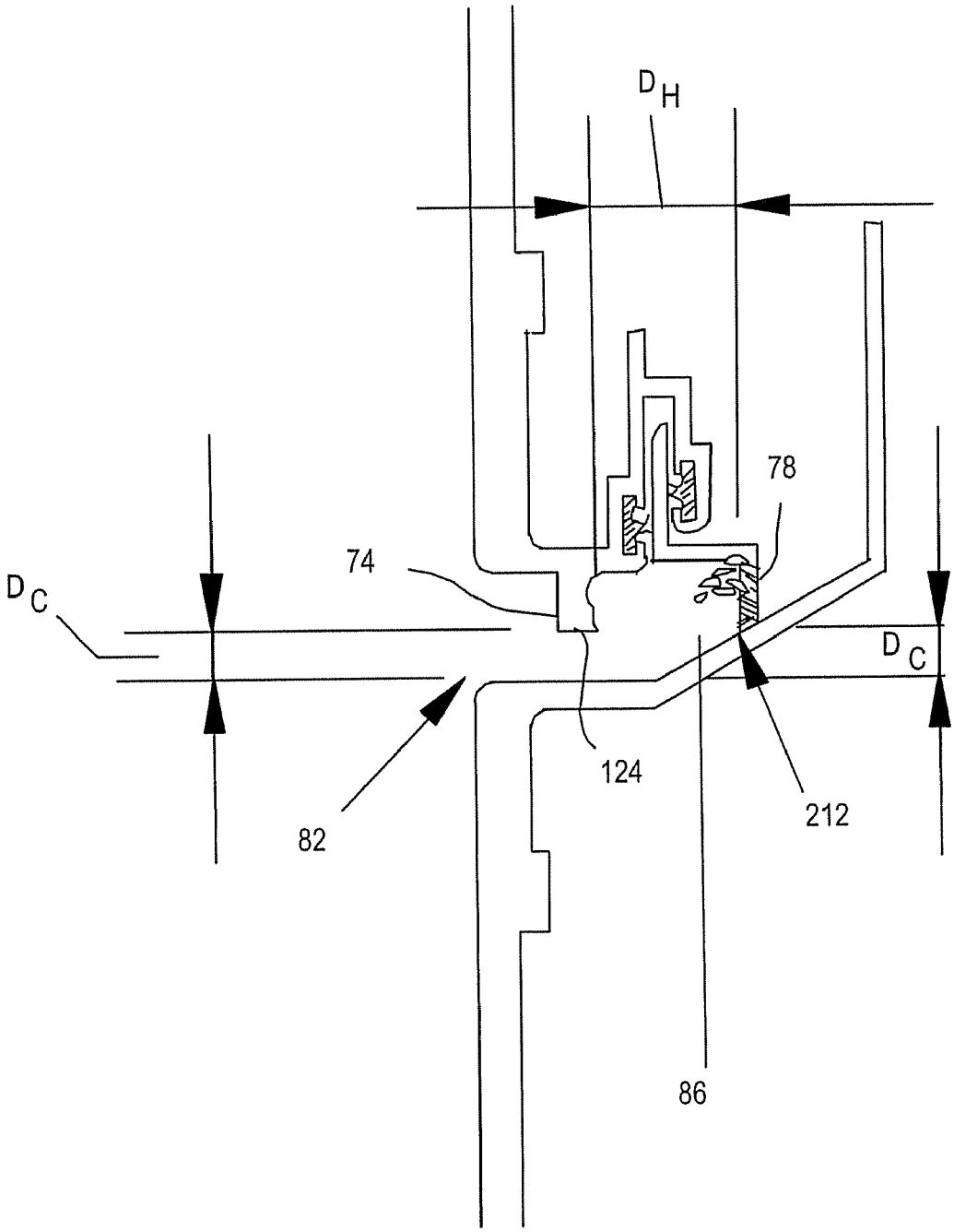
FIG. 5 is a third embodiment of a wall panel mounting system according to the first aspect of the present invention.

FIG. 5 depicts a third embodiment of a wall panel mounting assembly according to the first aspect of the present invention. In this third embodiment, drainage holes 200 are located above the free end 124 of the capillary break 78 with an inclined surface 212 extending from the drainage holes 200 to a point below the capillary break 208. The inclined surface 212 facilitates removal of fluids from the recess 82 and thereby inhibits build-up of fluids in a corner of the recess 82 (i.e., a corner of the chamber 86).

FIGS. 6A and 6B depict a fourth embodiment of a wall panel attachment system according to the second aspect of the present invention (this second aspect briefly described in the Summary of the Invention section hereinabove). The system uses a flexible sheet interlock 250 (FIG. 6B) to seal inline adjacent perimeter framing members (e.g., perimeter framing members 258*a* and 258*b*, which may correspond to one of the pairs of lower perimeter framing members 58*a,b* or 58*c,d* of FIGS. 1, 1A and 1C). At the joint or gap 284 between the perimeter framing members 258*a* and 258*b* of adjacent wall panels 54*a,b* (or 54*c,d*), a flexible sheet interlock 250 inhibits fluid migration along the joint defined by the adjacent ends 254*a,b* of the adjacent gutter segments (e.g., 83*a,b* in FIG. 6B) of the perimeter framing members 258*a* and 258*b*. The flexible sheet interlock 250 realizes this result by retaining fluids in the adjacent gutter segments 83*a,b*. Accordingly, the interface (e.g., 260, FIG. 7) between the flexible sheet interlock 250 and the gutter interior surfaces of the gutter walls 268*a,b,c* is substantially impervious to fluid migration. As can be seen from FIG. 6B, the flexible sheet interlock 250 has sufficient flexibility to conform to the "U"-shaped contour of the gutter segments 83*a* and 83*b*.

Figure 7:
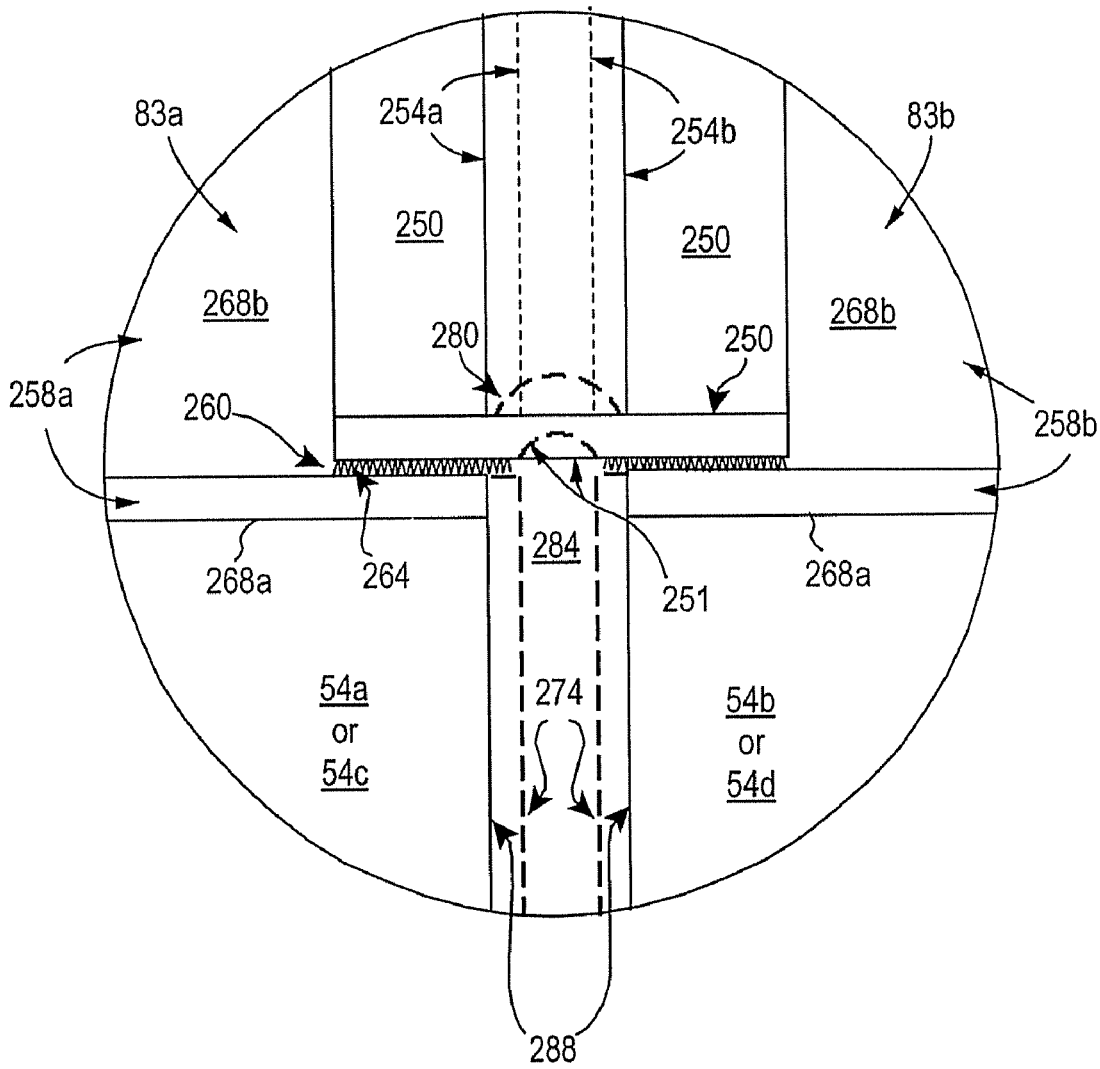
FIG. 7 depicts the behavior of the flexible sheet interlock 250 in response to thermal contractions in the wall panels.

Referring to FIGS. 6A, 6B, and FIG. 7, surface 251 of the flexible sheet interlock 250 between the adjacent ends 254*a,b* is shown, and in particular, in FIG. 7, this surface is shown in both an extended and bowed configuration. The interface 260 (FIG. 7) can include an adhesive 264 between the flexible sheet interlock 250 and each of the three gutter walls 268*a,b,c* to retain the interlock 250 in position. Although the flexible sheet interlock 250 itself may possess adhesive properties, an adhesive, preferably having sealing properties, has been found to assist the formation and maintenance of an integral seal between the interlock 250 and the gutter interior surfaces of the gutter walls 268*a,b,c*. The most preferred adhesive is a high performance compressed joint sealant that can "set up" or harden and bond to the gutter walls 268*a,b,c* and the interlock. Examples of such sealants include silicone, urethane, and epoxy. Because the interlock 250 itself absorbs all of the thermal movement of the wall panels, there is no requirement for the adhesive 264 to stay resilient and move. The end result is a more economical system for sealing the gap 284 between the gutter segments 83*a,b* of adjacent perimeter framing members (e.g., 258*a, b*) that has a useful life equal to that of the exterior wall panel system.

As can be seen from FIG. 7, when the perimeter framing members (e.g., 258*a, b*) are expanded due to thermal or building movements (e.g., the perimeter framing member positions denoted by arrows 274), the portion 280 of the interlock 250 in the gap 284 between the adjoining perimeter framing members deforms and thereby absorbs the movement without a failure of the seal provided by the adhesive 264. When the perimeter framing members (e.g., 258*a, b*) are in a relaxed state (e.g., the perimeter framing member positions denoted by arrows 288), the interlock 250 returns to its normal (i.e., extended) position.

Figure 8:
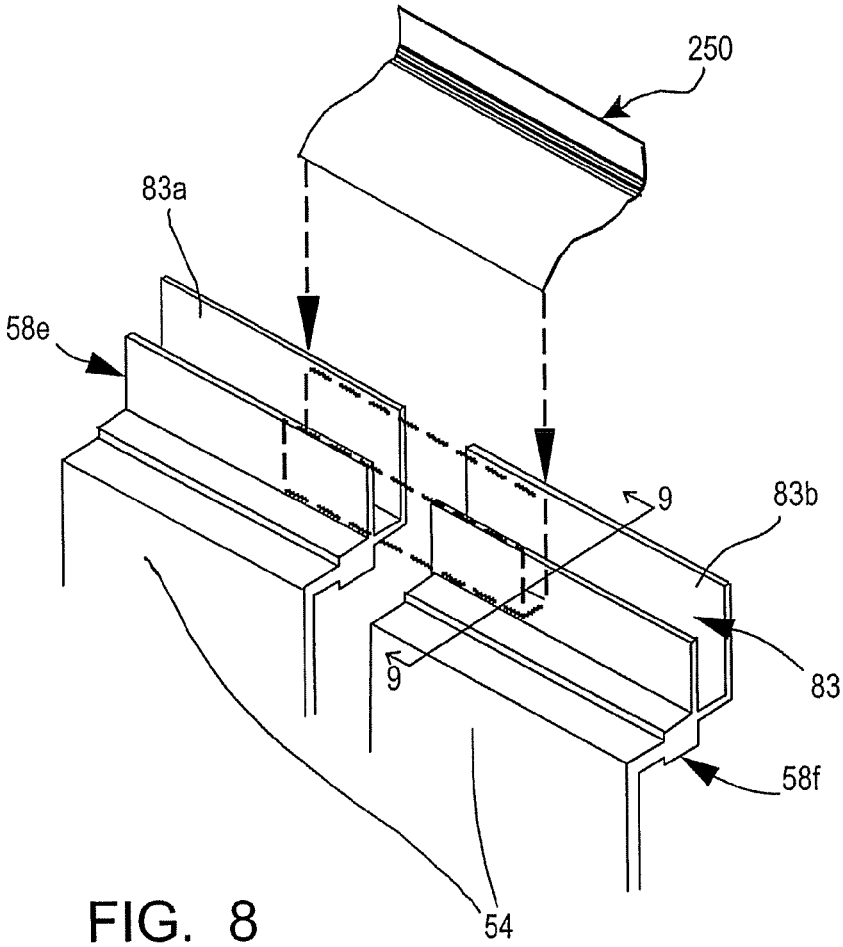
FIG. 8 depicts a first method for installing the flexible sheet interlock to seal a joint between adjacent perimeter framing members.
Figure 9:
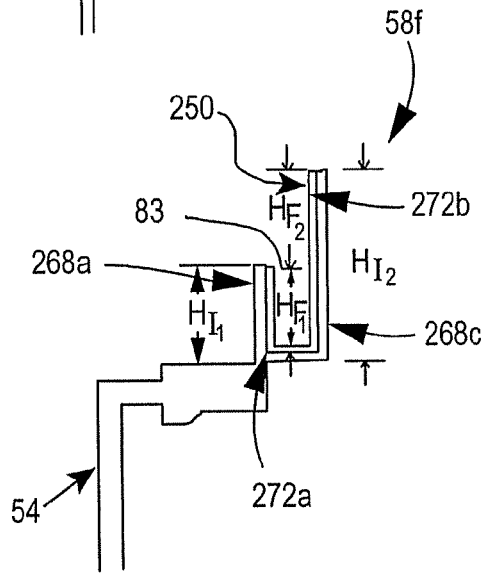
FIG. 9 is a sectional view along line 9-9 of FIG. 8.

Referring to FIGS. 8 and 9, embodiments of lower perimeter framing members 58*e* and 58*f* are shown, and additionally these figures show that the dimensions of the flexible interlock 250 are sufficient to prevent fluids from spilling over the sides of the interlock 250 before the fluid depth in the gutter 83 (provided by gutter segments 83*a,b*) reaches the depth of the gutter. After installation of the interlock 250 in the gutter 83, the two heights labeled "$H_{F_1}$" and "$H_{F_2}$" (FIG. 9) of the respective sides 272*a,c* of the interlock 250 are substantially the same as the heights "$H_{I_1}$" and "$H_{I_2}$" of the corresponding (i.e., adjacent) side walls 268*a,c* of the gutter.

FIGS. 8-9 also depict a method for installing the interlock 250 across the adjacent ends of the gutter segments 83*a,b*. The interlock 250 is pressed down in the gutter segments 83*a,b* until the interlock 250 substantially conforms to the interior shape of the gutter 83 as depicted in FIG. 9.

Figure 10:
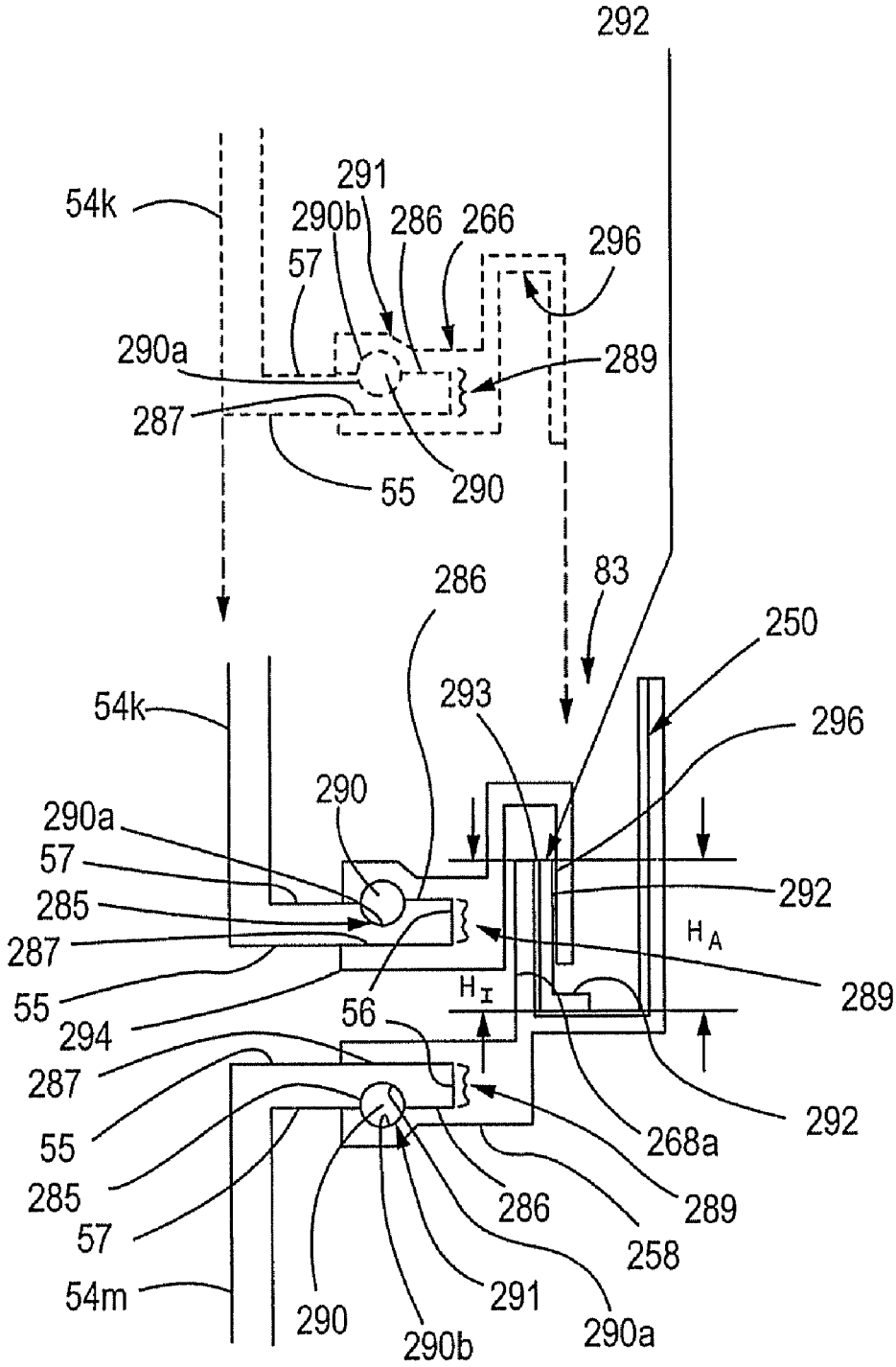
FIGS. 10-11 depict a second method for installing the flexible sheet interlock which uses a rigid insert to protect the edges of the flexible sheet interlock.

In FIGS. 10-13, alternative methods are depicted for installing the flexible sheet interlock 250 in the gutters 83 (e.g., gutter segments 83*a,b* in FIG. 6B). In a second method shown in FIGS. 10-11, a substantially rigid insert 292 can be employed to protect the exposed edge 293 of the interlock 250 during engagement of an upper perimeter framing member, and a lower perimeter framing member. In particular, the rigid insert 292 is shown in the context of another embodiment of the upper and lower perimeter framing members identified respectively in these figures by the labels 266 and 258. Note that the upper perimeter framing member 266 adjoins an upper wall panel 54*k*, and the lower perimeter framing member 258 adjoins a lower wall panel 54*m*. As will be appreciated, in the absence of the insert 292, the inner surface 296 of the upper perimeter framing member 266 can "roll up" the interlock 250 due to frictional forces during engagement of the upper and lower perimeter framing members 266 and 258 with one another. The "L"-shaped insert 292, which can be any substantially rigid material such as metal or plastic, is received between the upper and lower perimeter framing members (266, 258, respectively), and inhibits the rolling up of the interlock 250 when the perimeter framing members are placed into an interlocking relationship. The insert 292 and interlock 250 are positioned in a nested interlocking relationship as shown in FIG. 10. To operate effectively, the height "$H_A$" of the engaging surface 297 (FIG. 11) of the insert 292 has substantially the same length as the height "$H_I$" (FIG. 10) of the corresponding (i.e., adjacent) gutter wall 268*a*. As will be appreciated, the insert 292 is not required to be an "L"-shape but can be any other shape that matches the inner contour of the gutter 83 such as a "U"-shape.

Figure 11:
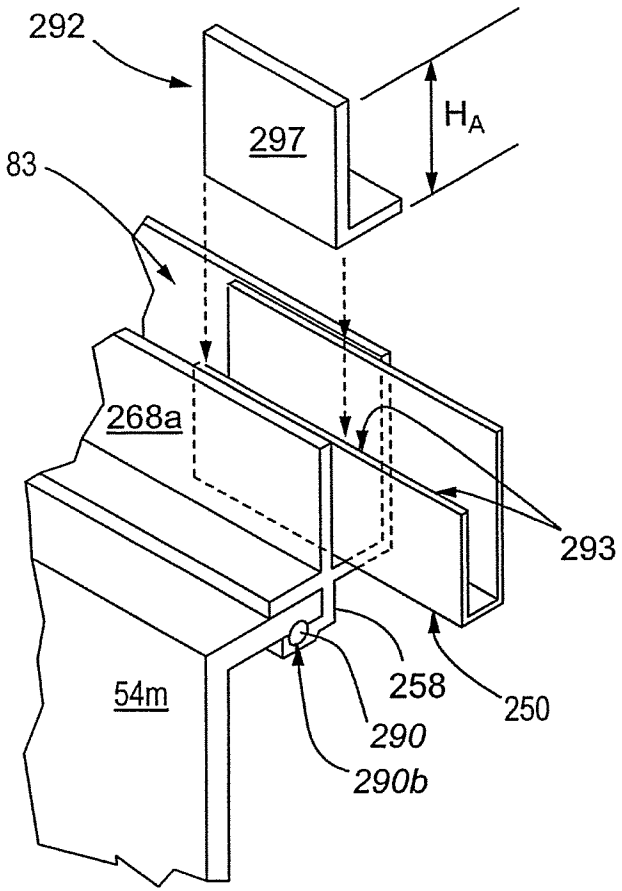

Note that FIGS. 10-11 also show other features for the wall panel attachment system disclosed herein. In particular, a pocket 289 is shown in each of: the lower perimeter framing member 266, and (in the dashed version of) the upper perimeter framing member 258. Each pocket 289 is a recess into which a corresponding portion of a panel 54 (e.g., 54*k* or 54*m*) can be received (e.g., a portion of the panel that is: (a) between the panel peripheral surfaces 55 and 57, and (b) extending to the panel's peripheral edge 56, wherein the panel surfaces 55 and 57 face substantially away from one another). Each pocket 289 is bounded by (and in part defined by) a pair of first and second opposing surfaces, 286 and 287 respectively. In addition to a panel's peripheral surfaces and edges, an attachment member 290 is also provided in each pocket 289. For each of the lower and upper perimeter framing members 258 and 266, one of the attachment members 290 is operably provided in the perimeter framing member's corresponding pocket 289 for securing a corresponding one of the panels 54*m* and 54*k* within the pocket (for example, wherein the peripheral surfaces 55 and 57, and, the edge 56 of the panel are received within the pocket 289). More precisely, for each of the attachment members 290:

(i) there is a corresponding semi-cylindrical grove or notch 285 within a surface of the corresponding adjacent panel 54 for mating with (or more generally, engaging) a corresponding surface portion 290*a* (also referred to as a "bearing surface") of the attachment member 290, and (ii) there is a corresponding semi-cylindrical groove (or more generally, "grooved member") 291 in each of the first of the opposing surfaces 286 for mating with (or generally, engaging) a corresponding surface portion 290*b* (also referred to as a "bearing surface") of the attachment member 290.

Figure 12:
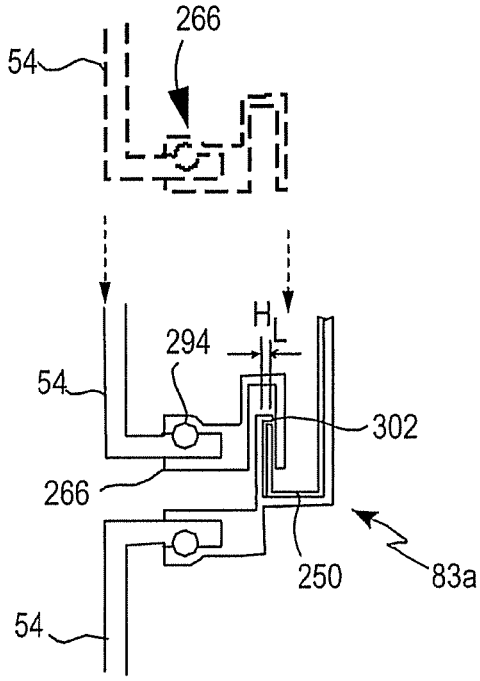
FIGS. 12-13 depict a third method for installing the flexible sheet interlock which uses a shelf or lip on the perimeter framing member to protect the edges of the flexible sheet interlock.
Figure 13:
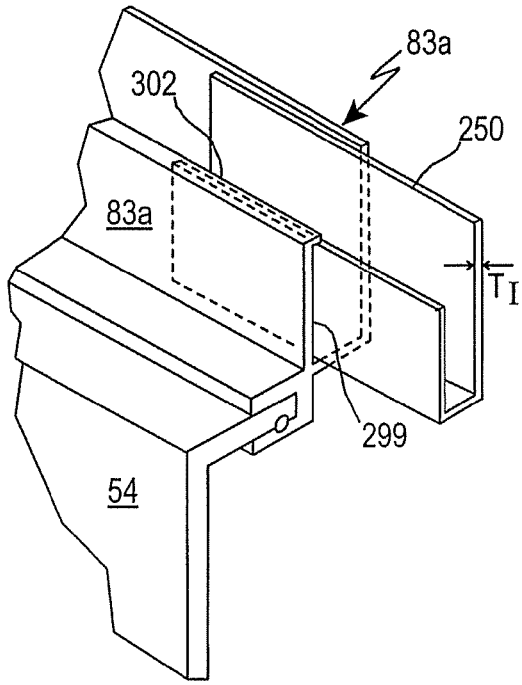

In a third method for installing the flexible sheet interlock 250 shown in FIGS. 12-13, the inner surface 299 of the gutter segment 83*a* includes a lip 302 extending inwardly to protect the edges of the interlock 250 during installation of the upper perimeter framing member 266. The width of the lip "$H_L$" (FIG. 12) is preferably at least the same as the thickness "$T_I$" (FIG. 13) of the interlock 250.

Figure 14:
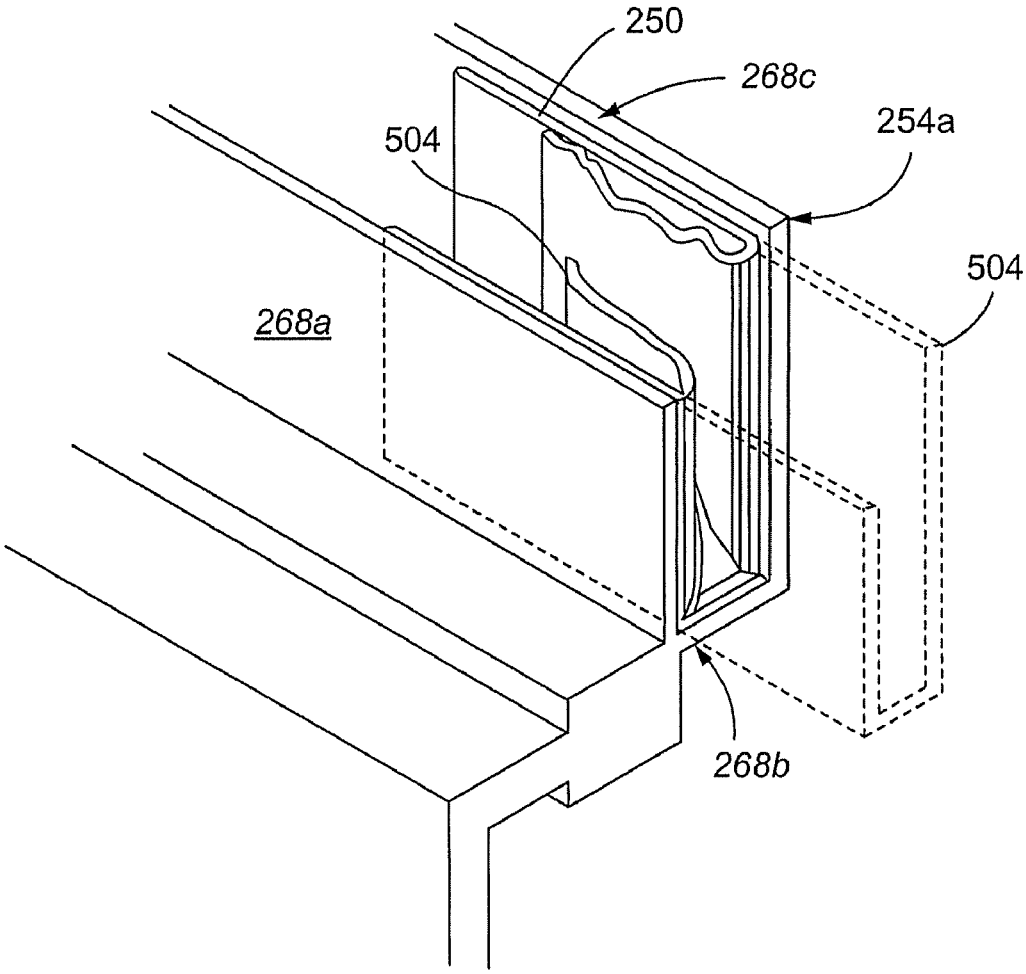
FIG. 14 depicts the exposed edges of the flexible sheet interlock being folded back onto itself during installation of an adjacent wall panel.
Figure 15:
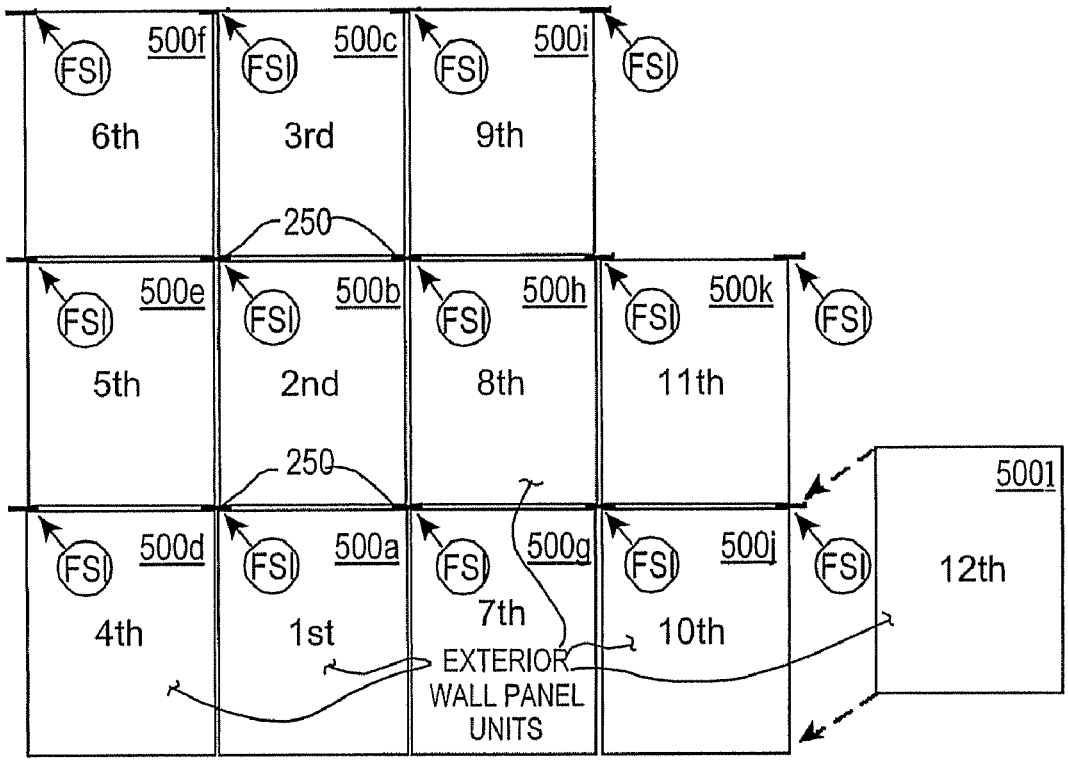
FIG. 15 depicts a preferred sequence for installing wall panels using the flexible sheet interlock, wherein instances of the flexible sheet interlock are identified by the label "FSI"
Figure 16:
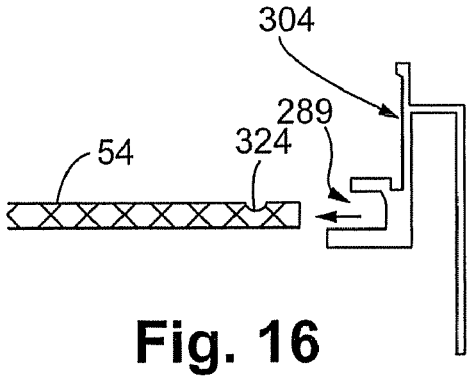
FIGS. 16-22 depict a fourth embodiment of a wall panel mounting system according to a third aspect of the present invention.

FIGS. 14 and 15 depict a preferred method for installing wall panel systems using the flexible sheet interlock 250 (identified by the label "FSI" in FIG. 15). The numbers on the wall panels (e.g., 1st, 2nd, 3rd, etc. in FIG. 15) denote the order in which the wall panels are attached to the wall support members. Although the conventional "stair step" method can also be employed with the interlock 250, the method of FIG. 15 is simpler, less expensive, and has more flexibility in installation.

The installation method will now be explained with reference to FIGS. 8-9 and 14-15. In a first step, the wall panel system 500*a* (FIG. 15) is attached to the wall support members. In a second step, the adhesive 264 (FIG. 7) is applied to either or both of a flexible sheet interlock 250 and adjoining interior gutter surfaces of walls 268*a-c* (FIG. 14), and the flexible sheet interlock 250 is engaged with each end 254*a,b* (FIGS. 6B and 14) of the wall panel system 500*a*. In a third step, the wall panel systems 500*b,c* are attached to the wall support members, wherein the corresponding flexible sheet interlocks 250 are attached to the ends of each system's gutter segment (e.g., 83*a* or 83*b*) as described above. In a fourth step, the protruding end 504 of the interlock 250 is folded away from the edge of the wall panel system 500*a* as shown in FIG. 14, and the wall panel system 500*d* is attached to the wall support members. A flexible sheet interlock 250 is then attached to the gutter segment (e.g., 83*a* or 83*b*) at the end of the wall panel system 500*d* as described hereinabove. The above steps are repeated to install the remaining wall panel systems 500*e*-500*l*.

Referring to FIGS. 16-21, a fourth embodiment according to a third aspect of the present invention is illustrated. The third aspect of the invention is used to attach embodiments of the wall panels to an alternative embodiment of the perimeter framing members denoted by the label 304 to distinguish it from the perimeter framing members described hereinabove. The wall panel assembly 300 (e.g., FIG. 19) includes a perimeter framing member 304, a wedge-shaped member 306, and an attachment member 308 (which secures a wall panel within a pocket 289, but differently from attachment member 290, FIG. 10, and which is preferably a rigid or semi-rigid material such as metal). The attachment member 308 has an L-shaped member 312 that engages a grooved member 316 in the perimeter framing member 304. The attachment member 308 has a cylindrically-shaped bearing surface 320 that is received in a groove 324 in a wall panel 54 (also identified as a panel member 54 herein) substantially along the length of the side of the panel member 54. One end 336 of the wedge-shaped member 306 engages a step 332 in the perimeter framing member 304 and the other end 340 of the wedge-shaped member 306 engages a step 344 in the attachment member 308. The wedge-shaped member 306 is suitably sized to cause the bearing surface 320 of the attachment member 308 to be forced against the groove 324 in the panel member, thereby holding the panel member in position. The bearing surface 320 can have any number of desired shapes, including v-shaped, star-shaped, and the like.

Figure 17:
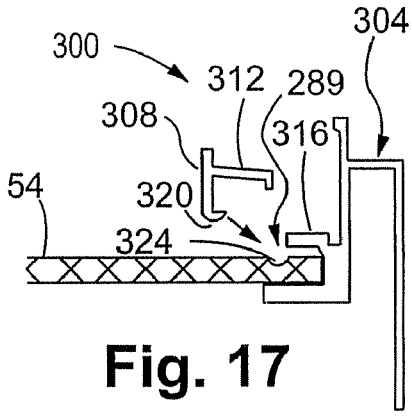
Figure 18:
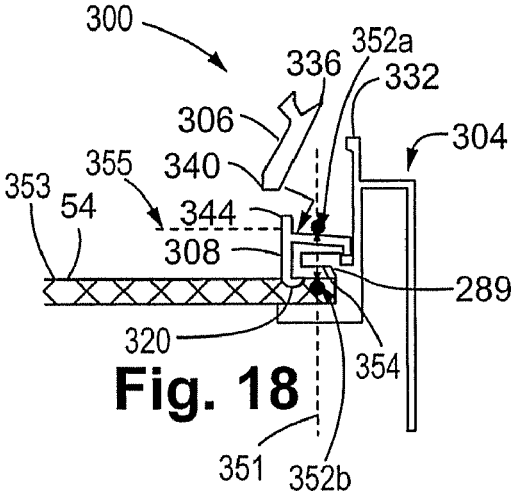
Figure 19:
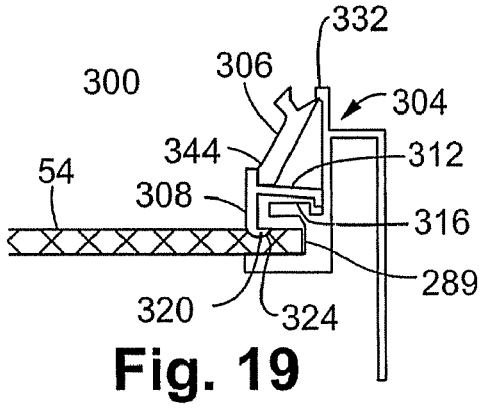
Figure 20:
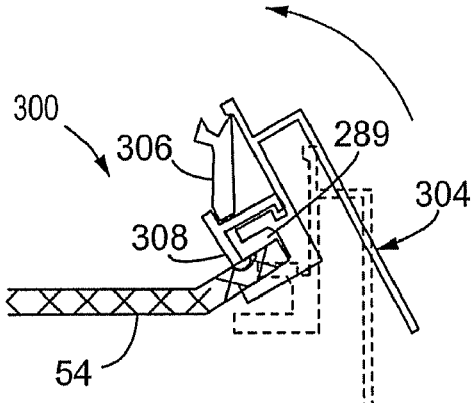
Figure 21:
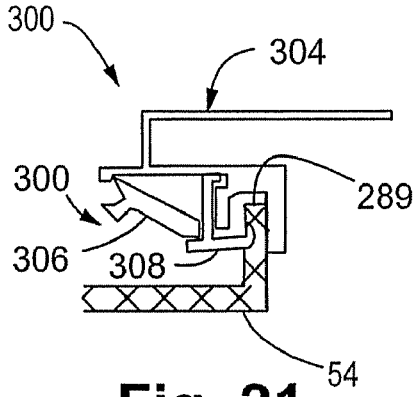

The steps to assemble the panel member assembly 300 are illustrated in FIGS. 16-21. In the first step illustrated by FIG. 16, the panel member 54 is positioned in the pocket 289 of the perimeter framing member 304. In FIG. 17, the L-shaped member 312 (which is part of the attachment member 308) is engaged with the grooved member 316 (FIG. 18) of the perimeter framing member 304, and the bearing surface 320 is engaged with the groove in the panel member 54. In FIGS. 18-19, the lower end 340 of the wedge-shaped member 306 is engaged with the step 344 of the attachment member, and the upper end 336 of the wedge-shaped member 306 is then forcibly engaged with the step 332 in the perimeter framing member 304. Note that as shown in FIG. 18, for an axis 351:

(i) having a first position 352*a* that is offset from the surface 353 of the panel member 54 on a side also having the surface 354 of the pocket 289, and (ii) having a second position 352*b* that is offset from the surface 353 on a side not having the surface 354, the attachment member 308 includes a portion that traverses the extent or separation between the first position and the second position. In the present embodiment, one such portion is the part of the attachment member 308 that extends from the bearing surface 320 to the dashed line 355. In FIGS. 20-21, the edge of the panel member 54 is bent at a 90 degree angle about a predetermined line in the panel member. Interlocking flanges of adjacent perimeter framing members can then be engaged to form the building surface.

FIGS. 22-28 depict a fifth embodiment according to the third aspect of the present invention. The wedge-shaped member 306 of the previous embodiment of FIGS. 16-21) is replaced with a screw 404 (FIGS. 23-28, alternatively, screw 404*a* or 404*b* in FIG. 22) or other fastener to hold the perimeter framing member 304 (FIGS. 23-28, alternatively, perimeter framing member 304*a* or 304*b* in FIG. 22), and the attachment member 308 (FIGS. 23-28, alternatively, attachment member 308*a* or 308*b* in FIG. 22) in position on the panel member 54 (FIGS. 23-28, alternatively, panel 54*n* or 54*p* in FIG. 22). The fastener passes through the attachment member and perimeter framing member.

Figure 22:
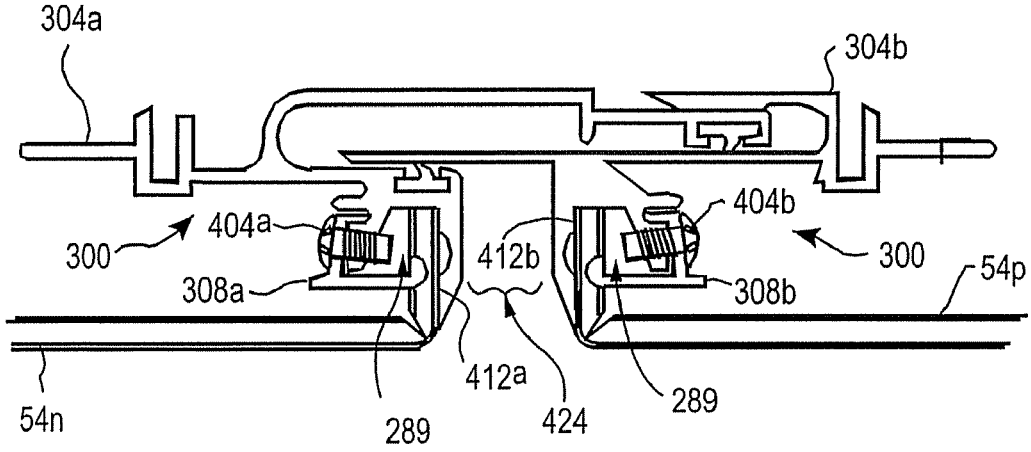
Figure 23:
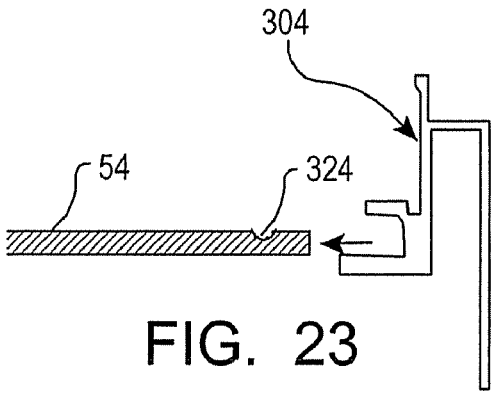
FIGS. 23-28 depict a fifth embodiment of a wall panel mounting system according to the third aspect of the present invention.
Figure 24:
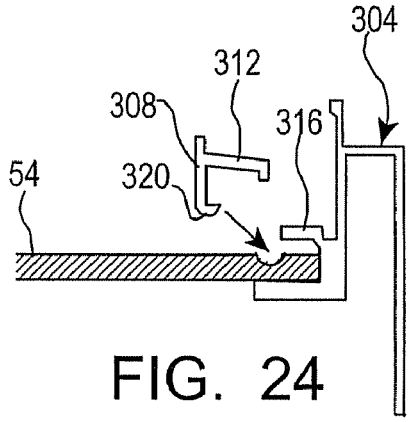
Figure 25:
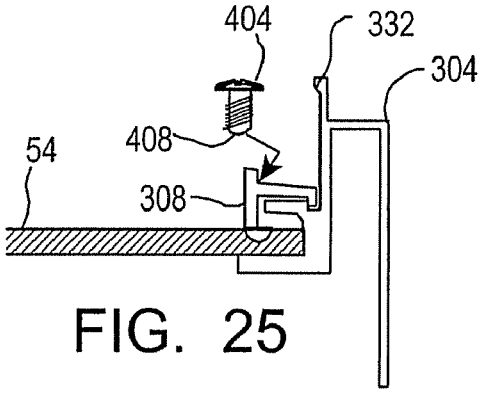
Figure 26:
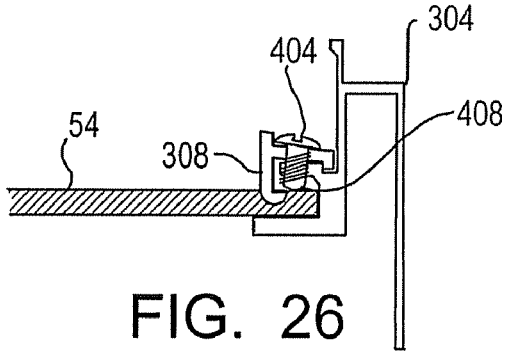
Figure 27:
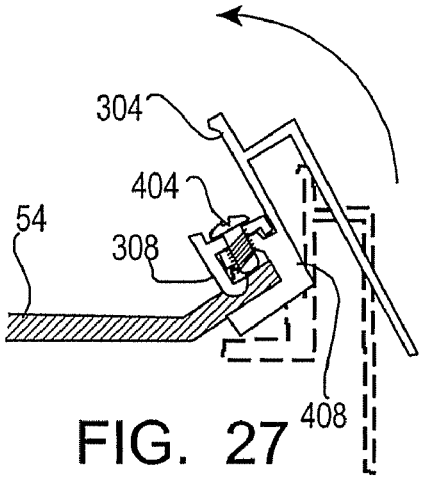
Figure 28:
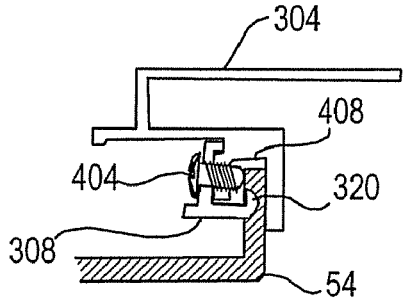

The steps to assemble each panel member assembly 300 of FIG. 22 are illustrated by FIGS. 23-28, with FIG. 23 illustrating the first step, FIG. 24 the second step, FIGS. 25-26 the third step, and FIGS. 27-28 the last step. Additionally, note that FIG. 22 depicts a somewhat different embodiment from that of FIGS. 23-28; e.g., FIG. 22 shows differently configured perimeter framing members 304*a,b* and attachment members 308*a,b* from the corresponding components in FIGS. 23-28.

The perimeter framing members 304*a,b* (FIG. 22) are in the interlocked position for mounting the panels on a support surface. Note that FIG. 22 shows the parallel surfaces 412*a* and 412*b* of the peripheral edges of the panels 54*n* and 54*p*, wherein each of the surfaces 412*a* and 412*b* engage an interior surface of a corresponding pocket 289 of one of the perimeter framing members 304*a* and 304*b* (such perimeter framing members also referred to as panel receiving members hereinbelow). Moreover, the panels 54*n* and 54*p* are spaced apart from one another by a channel or gap 424, wherein the channel or gap is bounded by facing sides, each side being provided by a different one of first and second perimeter framing members 304*a* and 304*b*, and each side being an exterior surface of one of the pockets 289 receiving a corresponding peripheral edge of one of the panels 54*n* and 54*p*.

While various embodiments have been described in detail, it is apparent that modifications and adaptations of those embodiments will occur to those skilled in the art. However, it is to be expressly understood that such modifications and adaptations are within the scope of these inventions, as set forth in the following claims.

What is claimed is:

1. In a joint between adjacent first and second perimeter framing members, the adjacent first and second perimeter framing members engaging first and second wall panels, respectively, at least one of the first and second perimeter framing members comprising a plurality of drainage holes, the plurality of drainage holes being in fluid communication with a gutter located in an interior region behind the first and second wall panels, the gutter collecting and providing to the drainage holes, for removal, moisture located in the interior region, a method for draining a terrestrial fluid from the joint, comprising:

(a) passing a terrestrial fluid through a gap between a capillary break on at least one of the first and second perimeter framing members, and an opposing surface of the other of the at least one of the first and second perimeter framing members;

(b) passing the terrestrial fluid into a circulating chamber defined by the capillary break and walls of the first and second perimeter framing members, wherein the circulating chamber is located between the drainage holes and the capillary break;

(c) collecting the terrestrial fluid in the circulating chamber, wherein at least one of the drainage holes is located so as to drain the terrestrial fluid from the gutter and into the circulating chamber; and (d) passing the collected terrestrial fluid, in the form of a liquid, through the gap and into an exterior environment by a passage extending from the circulating chamber to the exterior environment that excludes the drainage holes.

2. The method of claim 1, wherein an inlet is defined by the adjacent first and second perimeter framing members and the terrestrial fluid, when passing through the inlet toward the capillary break, has an input velocity, and wherein a first velocity of the terrestrial fluid is generated as the terrestrial fluid moves past the capillary break, the first velocity is more than the input velocity.

3. The method of claim 2, wherein a lower surface of the circulating chamber slopes downwardly in a direction of at least a portion of the inlet and wherein, in the passing step (d), the fluid is in the form of a water film.

4. A method for retarding the entry of terrestrial fluids into drainage holes, comprising:

providing first and second perimeter framing members holding opposing surfaces of first and second panels, respectively, at least one of the first and second perimeter framing members comprising a plurality of drainage holes, the plurality of drainage holes to be in fluid communication with a gutter located in an interior region behind the first and second panels, wherein the gutter collects and provides to the drainage holes, for removal, moisture located in the interior region, wherein the first perimeter framing member comprises a capillary break operable to pass a terrestrial fluid at a first velocity through a gap defined by a free end of the capillary break and an opposing surface of the second perimeter framing member, wherein the first and second perimeter framing members are configured to define a circulating chamber operable to provide the terrestrial fluid at a second velocity that has a magnitude lower than the first velocity, wherein the circulating chamber and the plurality of drainage holes are both located on an interior side of the capillary break, wherein the circulating chamber is located between the drainage holes and the capillary break, wherein a lower surface of the circulating chamber is contoured to permit terrestrial fluids collected in the circulating chamber to flow, as a liquid, through the gap along the lower surface for discharge into an exterior environment, and wherein the capillary break extends downwardly from the first perimeter framing member and the plurality of drainage holes are located above the free end of the capillary break; and mounting the first and second perimeter framing members to at least one structural member of a structure.

5. The method of claim 4, wherein the circulating chamber has a sloped lower surface contoured to permit terrestrial fluids in the circulating chamber to flow along the lower surface and into the exterior environment and wherein an adjacent edge of a nearest drainage hole is at least about 0.75 inches from an interior facing surface of the capillary break.

6. The method of claim 4, wherein a first space between the free end of the capillary break and the opposing surface of the second perimeter framing member has a first vertical cross-sectional area, and a second space between opposing walls of the circulating chamber at a point between the capillary break and the plurality of drainage holes has a second vertical cross-sectional area, and the second vertical cross sectional area is at least about 150% of the first vertical cross sectional area.

7. The method of claim 4, wherein, at any location along the capillary break, a nearest edge of a nearest drainage hole is at least about 0.25 inches from a rear surface of the capillary break.

8. The method of claim 4, wherein the centers of the plurality of drainage holes lie along an axis and wherein a distance of the drainage holes above the free end of the capillary break is at least about 125% of a distance from the free end of the capillary break to the opposing surface of the second perimeter framing member.

9. The method of claim 4, wherein a surface of the capillary break adjacent to the plurality of drainage holes is concave and wherein the first and second panels each is a composite of metal and plastic.

10. The method of claim 4, wherein the plurality of drainage holes are spaced at regular intervals along the at least one of the first and second perimeter framing members, wherein a height of the capillary break ranges from about 125% to about 200% of a distance between the free end of the capillary break and an adjacent, opposing surface of the circulating chamber.

11. The method of claim 4, wherein the plurality of drainage holes are located on one of the first and second perimeter framing members and the capillary break is located on the other of one of the first and second perimeter framing members.

12. The method of claim 7, wherein openings of the plurality of drainage holes are located in an at least substantially horizontal surface.

13. The method of claim 5, wherein the plurality of drainage holes are located on the first perimeter framing member and the capillary break is located on the second perimeter framing member, wherein openings of the plurality of drainage holes are located on an at least substantially vertical surface, and wherein the openings of the plurality of drainage holes are located above a free end of the capillary break.

14. The method of claim 13, wherein the capillary break has a height and is separated by a gap from the first perimeter framing member and the height is at least about 100% of the width of the gap and wherein exterior surfaces of the first and second panels are at least substantially parallel and coplanar.

15. A method for draining a terrestrial fluid from between first and second perimeter framing members while inhibiting passage of terrestrial fluids from an exterior environment into a drainage hole, comprising:

(a) providing first and second perimeter framing members holding opposing surfaces of first and second panels, respectively, at least one of the first and second perimeter framing members comprising a plurality of drainage holes, the plurality of drainage holes being in fluid communication with a gutter located in an interior region behind the first and second panels, wherein the gutter collects a terrestrial fluid, and provides the terrestrial fluid to the drainage holes for transfer from the interior region, wherein at least one of the drainage holes is located above a free end of a capillary break, and the capillary break is between the exterior environment and the at least one of the drainage holes;

(b) causing a terrestrial fluid to pass through an inlet defined by the first and second perimeter framing members, the inlet comprising a gap between the capillary break on at least one of the first and second perimeter framing members, wherein the terrestrial fluid has a first velocity when passing through the gap;

(c) causing the first velocity of the terrestrial fluid to drop to a lower, second velocity in a circulating chamber, the circulating chamber being defined by the capillary break and surfaces of the first and second framing members, wherein the circulating chamber is located between the drainage holes and the capillary break;

(d) causing collection of the terrestrial fluid on a sloped lower surface of the circulating chamber; and (e) causing drainage of the collected terrestrial fluid, in the form of a liquid, through the gap and inlet and into the exterior environment by a passage extending from the circulating chamber to the exterior environment that excludes the drainage holes.

16. The method of claim 15, wherein the first and second panels are each a composite of metal and plastic, wherein, in the causing step (e), the terrestrial fluid is in the form of a water film, and wherein the gutter communicates with the interior region.

17. The method of claim 15, wherein, at any location along the capillary break, a distance between a rear surface of the capillary break and an opening of a nearest drainage hole is at least about 0.75 inches and the plurality of drainage holes are located above a free end of the capillary break.

18. The method of claim 1, wherein a free end of the capillary break is separated from one of the first and second perimeter framing members by the gap, wherein a lower surface of the circulating chamber is contoured to permit the collected terrestrial fluid to flow along the lower surface through the gap and inlet for discharge into the exterior environment, wherein the capillary break is located above the gap, and wherein a plurality of drainage holes are located above the free end of the capillary break.

19. The method of claim 18, wherein the capillary break is located exteriorly of the plurality of drainage holes.

20. The method of claim 15, wherein a free end of the capillary break is separated from one of the first and second perimeter framing members by the gap, wherein the collected terrestrial fluid flows along the sloped lower surface through the gap and inlet for discharge into the exterior environment, and wherein the capillary break is located above the gap and the plurality of drainage holes is located above the free end of the capillary break and interiorly of the capillary break.

21. A method for inhibiting a terrestrial fluid from collecting in an interior region behind adjacent, interconnecting first and second perimeter framing members, comprising:

providing adjacent and interconnecting first and second perimeter framing members, the first and second perimeter framing members providing: (a) an inlet, (b) a capillary break blocking at least part of the inlet, (c) a circulating chamber positioned interiorly of the capillary break, and (d) a plurality of drainage holes, separated from the inlet by the capillary break, in fluid communication with a gutter located in an interior region of the first and second perimeter framing members, wherein at least one of the drainage holes is positioned above a free end of the capillary break for draining a terrestrial fluid from the gutter;

wherein the gutter collects and provides to the drainage holes, for removal, moisture located in the interior region, wherein the circulating chamber is located between the drainage holes and the capillary break, and wherein a lower surface of the circulating chamber slopes downwardly towards the inlet for transporting terrestrial fluids collected in the circulating chamber past the capillary break and through the inlet to the exterior environment;

collecting a terrestrial fluid in the circulating chamber; and transporting the collected terrestrial fluid, in the form of a liquid, from the circulating chamber to and through the inlet and into the exterior environment.

22. The method of claim 21, wherein the gutter communicates with the interior region, wherein a free end of the capillary break is separated from one of the first and second perimeter framing members by a gap and wherein the capillary break is located above the gap, and the plurality of drainage holes is located above the free end of the capillary break.

23. The method of claim 22, wherein the drainage holes are located interiorly of the capillary break and wherein, in the transporting step, the terrestrial fluid is in the form of a water film.

24. The method of claim 1, wherein the gutter is open to the interior region.

25. The method of claim 4, wherein a side of the gutter is open to the interior region.

26. The method of claim 1, wherein the terrestrial fluid, when passing through the gap toward the circulating chamber, has a first velocity, and in the circulating chamber, the terrestrial fluid has a second velocity that is lower than the first velocity.

27. The method of claim 15, wherein at least one of the drainage holes drains into the circulating chamber, and wherein the capillary break is located above the gap.

28. In a joint between adjacent first and second perimeter framing members, the adjacent first and second perimeter framing members engaging first and second wall panels, respectively, at least one of the first and second perimeter framing members comprising a plurality of drainage holes, the plurality of drainage holes being in fluid communication with a gutter located in an interior region behind the first and second wall panels, the gutter collecting and providing to the drainage holes, for removal, moisture located in the interior region, a method, comprising:

(a) passing a terrestrial fluid through a gap between a capillary break on at least one of the first and second perimeter framing members and an opposing surface of the other of the at least one of the first and second perimeter framing members;

(b) passing the terrestrial fluid into a circulating chamber defined by the capillary break and walls of the first and second perimeter framing members, wherein the circulating chamber is located between the drainage holes and the capillary break;

(c) collecting the terrestrial fluid in the circulating chamber; and (d) passing the collected terrestrial fluid, in the form of a liquid, through the gap and into an exterior environment by a passage extending from the circulating chamber to the exterior environment that excludes the drainage holes;

wherein a free end of the capillary break is separated from one of the first and second perimeter framing members by the gap, wherein a lower surface of the circulating chamber is contoured to permit the collected terrestrial fluid to flow along the lower surface through the gap and inlet for discharge into the exterior environment, wherein the capillary break is located above the gap, and wherein the plurality of drainage holes are located above the free end of the capillary break; and wherein the capillary break is located exteriorly of the plurality of drainage holes.

29. A method for inhibiting passage of terrestrial fluids from an exterior environment into a drainage hole, comprising:

(a) providing first and second perimeter framing members holding opposing surfaces of first and second panels, respectively, at least one of the first and second perimeter framing members comprising a plurality of drainage holes, the plurality of drainage holes being in fluid communication with a gutter located in an interior region behind the first and second panels, wherein the gutter collects and provides to the drainage holes, for removal, moisture located in the interior region;

(b) causing a terrestrial fluid to pass through an inlet defined by the first and second perimeter framing members, the inlet comprising a gap between a capillary break on at least one of the first and second perimeter framing members, wherein the terrestrial fluid has a first velocity when passing through the gap;

(c) causing the first velocity of the terrestrial fluid to drop to a lower, second velocity in a circulating chamber, the circulating chamber being defined by the capillary break and surfaces of the first and second framing members, wherein the circulating chamber is located between the drainage holes and the capillary break;

(d) causing collection of the terrestrial fluid on a sloped lower surface of the circulating chamber; and (e) causing drainage of the collected terrestrial fluid, in the form of a liquid, through the gap and inlet and into the exterior environment by a passage extending from the circulating chamber to the exterior environment that excludes the drainage holes;

wherein a free end of the capillary break is separated from one of the first and second perimeter framing members by the gap, wherein the collected terrestrial fluid flows along the sloped lower surface through the gap and inlet for discharge into the exterior environment, and wherein the capillary break is located above the gap and the plurality of drainage holes are located above the free end of the capillary break and interiorly of the capillary break.

30. A method for inhibiting a terrestrial fluid from collecting in an interior region behind adjacent, interconnecting first and second perimeter framing members, comprising:

providing adjacent and interconnecting first and second perimeter framing members, the first and second perimeter framing members providing: (a) an inlet, (b) a capillary break blocking at least part of the inlet, (c) a circulating chamber positioned interiorly of the capillary break, and (d) a plurality of drainage holes, separated from the inlet by the capillary break, in fluid communication with a gutter located in an interior region of the first and second perimeter framing members, wherein the gutter collects and provides to the drainage holes for removal moisture located in the interior region, wherein the circulating chamber is located between the drainage holes and the capillary break, and wherein a lower surface of the circulating chamber slopes downwardly towards the inlet for transporting terrestrial fluids collected in the circulating chamber past the capillary break and through the inlet to the exterior environment;

collecting a terrestrial fluid in the circulating chamber; and transporting the collected terrestrial fluid, in the form of a liquid, from the circulating chamber to and through the inlet and into the exterior environment;

wherein the gutter communicates with the interior region, wherein a free end of the capillary break is separated from one of the first and second perimeter framing members by a gap and wherein the capillary break is located above the gap and the plurality of drainage holes is located above the free end of the capillary break; and wherein the drainage holes are located interiorly of the capillary break and wherein, in the transporting step, the fluid is in the form of a water film.

31. The method of claim 1, wherein the capillary break extends downwardly to a free end thereof.

32. The method of claim 31, wherein a height of at least one of the drainage holes is above the free end of the capillary break.

* * * * *